US008503896B2

(12) United States Patent
Inukai et al.

(10) Patent No.: US 8,503,896 B2
(45) Date of Patent: Aug. 6, 2013

(54) IMAGE FORMATION DEVICE AND IMAGE FORMATION METHOD TO PREVENT SPARK DISCHARGE

(75) Inventors: Katsumi Inukai, Aichi (JP); Masamitsu Takahashi, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 906 days.

(21) Appl. No.: 12/569,704

(22) Filed: Sep. 29, 2009

(65) Prior Publication Data

US 2010/0080593 A1 Apr. 1, 2010

(30) Foreign Application Priority Data

Sep. 29, 2008 (JP) ..... 2008-251836
Feb. 23, 2009 (JP) ..... 2009-038927

(51) Int. Cl.
*G03G 15/02* (2006.01)

(52) U.S. Cl.
USPC ..... 399/50; 399/171

(58) Field of Classification Search
USPC ..... 399/50, 170–173
See application file for complete search history.

(56) References Cited

U.S. PATENT DOCUMENTS

2002/0191357 A1* 12/2002 Dickhoff et al.
2005/0200309 A1 9/2005 Kamiya

FOREIGN PATENT DOCUMENTS

| | | | |
|---|---|---|---|
| JP | 02097981 A | * | 4/1990 |
| JP | H03-253919 A | | 11/1991 |
| JP | H04-301862 A | | 10/1992 |
| JP | H08-146717 A | | 6/1996 |
| JP | H08-202171 A | | 8/1996 |
| JP | H11-024371 A | | 1/1999 |
| JP | 2000-267521 A | | 9/2000 |
| JP | 2000-356891 A | | 12/2000 |
| JP | 2005-189355 A | | 7/2005 |
| JP | 2006-243542 A | | 9/2006 |
| JP | 2006-330648 A | | 12/2006 |

OTHER PUBLICATIONS

Japan Patent Office, Notification of Reasons for Rejection for Japanese Patent Application No. 2009-038927 (counterpart to above-captioned patent application), dispatched Aug. 17, 2010.

* cited by examiner

*Primary Examiner* — Walter L Lindsay, Jr.
*Assistant Examiner* — Milton Gonzalez
(74) *Attorney, Agent, or Firm* — Baker Botts L.L.P.

(57) ABSTRACT

An image formation device for forming an image on a print medium by an electrophotographic process comprises a photosensitive body on which a developer image to be transferred to the print medium is formed by the electrophotographic process including charging of the photosensitive body, a charging unit which includes a charging wire and a grid and thereby electrically charges the photosensitive body, a charging power unit which applies wire potential to the charging wire, a wire potential measuring unit which measures the wire potential, and a charging control unit which controls the amount of electric charge supplied from the charging unit to the photosensitive body by controlling the wire potential based on the wire potential measured by the wire potential measurement unit. The charging control unit includes a control range restricting unit which restricts a control range of the wire potential within a prescribed electric potential.

16 Claims, 18 Drawing Sheets

CONTROL BLOCK DIAGRAM IN SECOND EMBODIMENT

CONTROL BLOCK DIAGRAM IN FIFTH EMBODIMENT

IMAGE FORMATION DEVICE AND IMAGE FORMATION METHOD TO PREVENT SPARK DISCHARGE

CROSS-REFERENCE TO RELATED APPLICATION

This application claims priority under 35 U.S.C. §119 from Japanese Patent Applications No. 2008-251836 filed on Sep. 29, 2008 and No. 2009-038927 filed on Feb. 23, 2009. The entire subject matter of the applications is incorporated herein by reference.

BACKGROUND

1. Technical Field

The following description relates to an image formation device and an image formation method.

2. Related Art

An image formation device for forming an image on a print medium (e.g. paper) uses high-voltage electric power for various electrophotographic processes (steps) such as charging, exposure, development, image transfer and fixation. Among the processes, the charging process involves a problem in that the charging function of a charging unit for electrically charging a photosensitive body (e.g. photosensitive drum) is easily deteriorated by contamination (stains, oxidation) of a charging wire of the charging unit. In a conventional technology for resolving the problem, the charging function of the charging unit is maintained by successively increasing a target value (for constant-potential control (constant electric potential control) of the charging wire) stepwise in response to the decrease in the charging voltage of the photosensitive body. When the target value exceeds an electric potential that can cause an electric leak or failure to the charging unit, the user is requested to clean the charging wire.

However, the conventional technology (just restricting the target value) is incapable of preventing spark discharge (full-path dielectric breakdown) which is caused by a temporary increase (transient rise) in the electric potential of the charging wire. Since the spark discharge damages the charging unit and the photosensitive body and seriously deteriorates the image quality, the request to the user for the cleaning of the charging unit has to be made frequently for the prevention of the spark discharge.

SUMMARY

In consideration of the above problems, aspects of the invention are advantageous in that a technology capable of preventing the spark discharge in the electric power control in the charging process can be provided.

In accordance with an aspect of the present invention, there is provided an image formation device for forming an image on a print medium by an electrophotographic process, comprising a photosensitive body on which a developer image to be transferred to the print medium is formed by the electrophotographic process including charging of the photosensitive body, a charging unit which includes a charging wire and a grid and thereby electrically charges the photosensitive body, a charging power unit which applies wire potential to the charging wire, a wire potential measuring unit which measures the wire potential, and a charging control unit which controls the amount of electric charge supplied from the charging unit to the photosensitive body by controlling the wire potential. The charging control unit includes a control range restricting unit which restricts a control range of the wire potential within a prescribed electric potential.

In accordance with another aspect of the present invention, there is provided an image formation method for forming an image on a print medium by an electrophotographic process including electrical charging of a photosensitive body using a charging unit including a charging wire and a grid, exposure of the electrically charged photosensitive body, formation of a developer image on the photosensitive body by development, and transfer of the developer image to the print medium. The image formation method comprises a charging power application step of applying wire potential to the charging wire, a wire potential measurement step of measuring the wire potential, and a charging control step of controlling the amount of electric charge supplied from the charging unit to the photosensitive body by controlling the wire potential based on the wire potential measured by the wire potential measurement step. The charging control step includes a control range restricting step of restricting a control range of the wire potential within a prescribed electric potential.

Other objects, features and advantages of the present invention will become more apparent from the consideration of the following detailed description taken in conjunction with the accompanying drawings.

BRIEF DESCRIPTION OF THE ACCOMPANYING DRAWINGS

DETAILED DESCRIPTION

Figure 1:
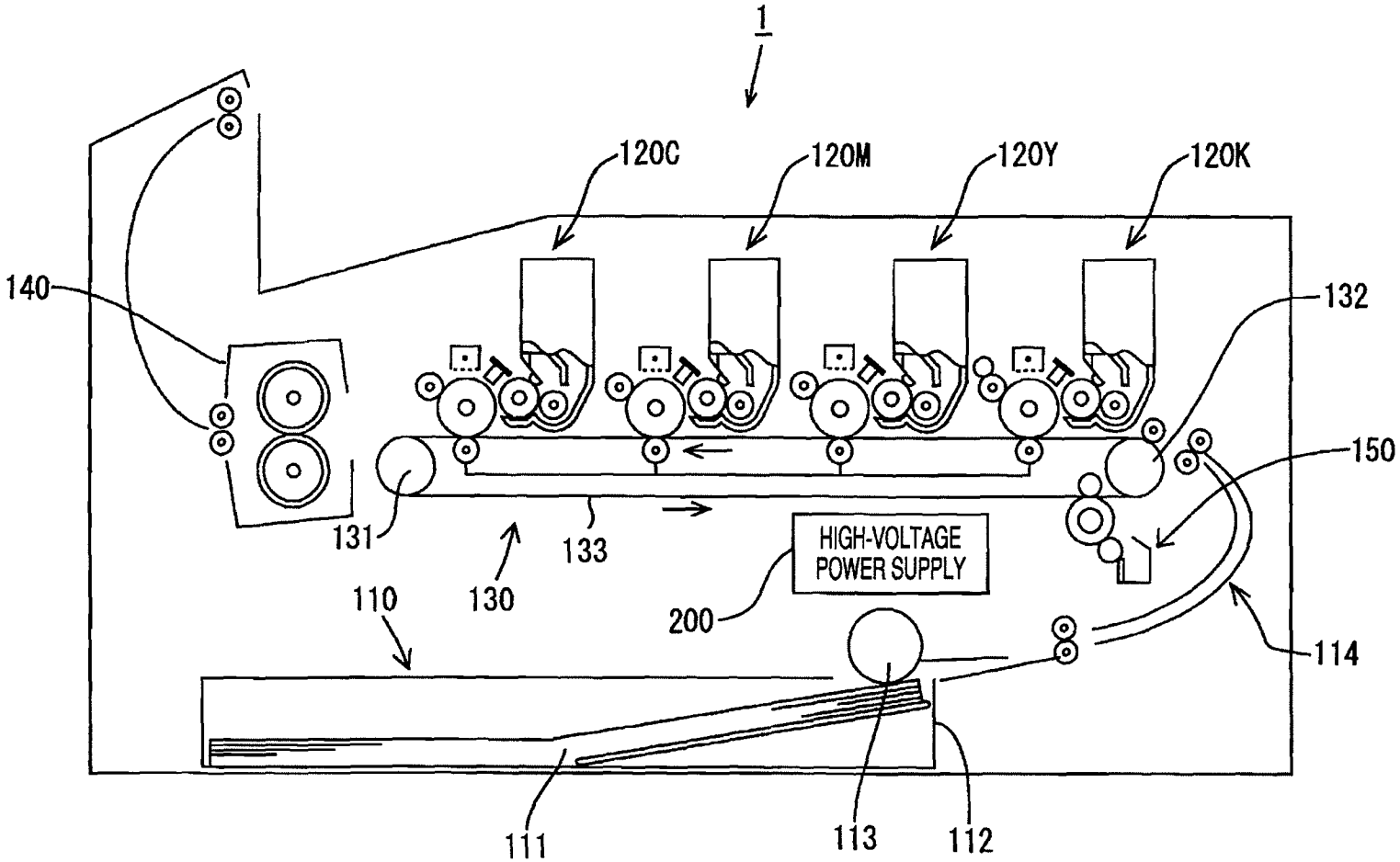
FIG. 1 is a schematic cross-sectional view showing the internal configuration of a printer (image formation device) in accordance with an embodiment of the present invention.

Referring now to the drawings, a description will be given in detail of preferred embodiments in accordance with the present invention.

FIG. 1 is a schematic cross-sectional view showing the internal configuration of a printer 1 (example of an image formation device) in accordance with an embodiment of the present invention. The printer 1 in this embodiment is an electrophotographic printer which carries out the exposure process by use of light emitted from lasers, LEDs (Light-Emitting Diode), etc. and then forms an image on a print medium (e.g., paper) using toners of four colors CMYK (Cyan, Magenta, Yellow, blacK).

The printer 1 is equipped with a sheet feed unit 110, image formation units 120C, 120M, 120Y and 120K for the four colors CMYK, a feeding mechanism 130, a fixation unit 140, a belt cleaning mechanism 150 and a high-voltage power supply 200. The high-voltage power supply 200 supplies electric power of various voltages to the image formation units 120C, 120M, 120Y and 120K and components of the feeding mechanism 130 (explained later). The internal configuration of the high-voltage power supply 200 will be explained later.

The sheet feed unit 110 includes a tray 112 which stores a stack of sheets 111 (paper, OHP sheets, etc.) to be printed on, a pickup roller 113 which successively picks up (extracts) the sheets 111 from the sheet stack one by one, and a sheet supply mechanism 114 which supplies the extracted sheet 111 to the feeding mechanism 130.

The feeding mechanism 130 feeds the sheet 111 successively to the image formation unit 120K, the image formation unit 120Y, the image formation unit 120M and to the image formation unit 120C. The feeding mechanism 130 includes a drive roller 131, a driven roller 132 and a belt 133 stretched between the drive roller 131 and the driven roller 132.

Figure 2:
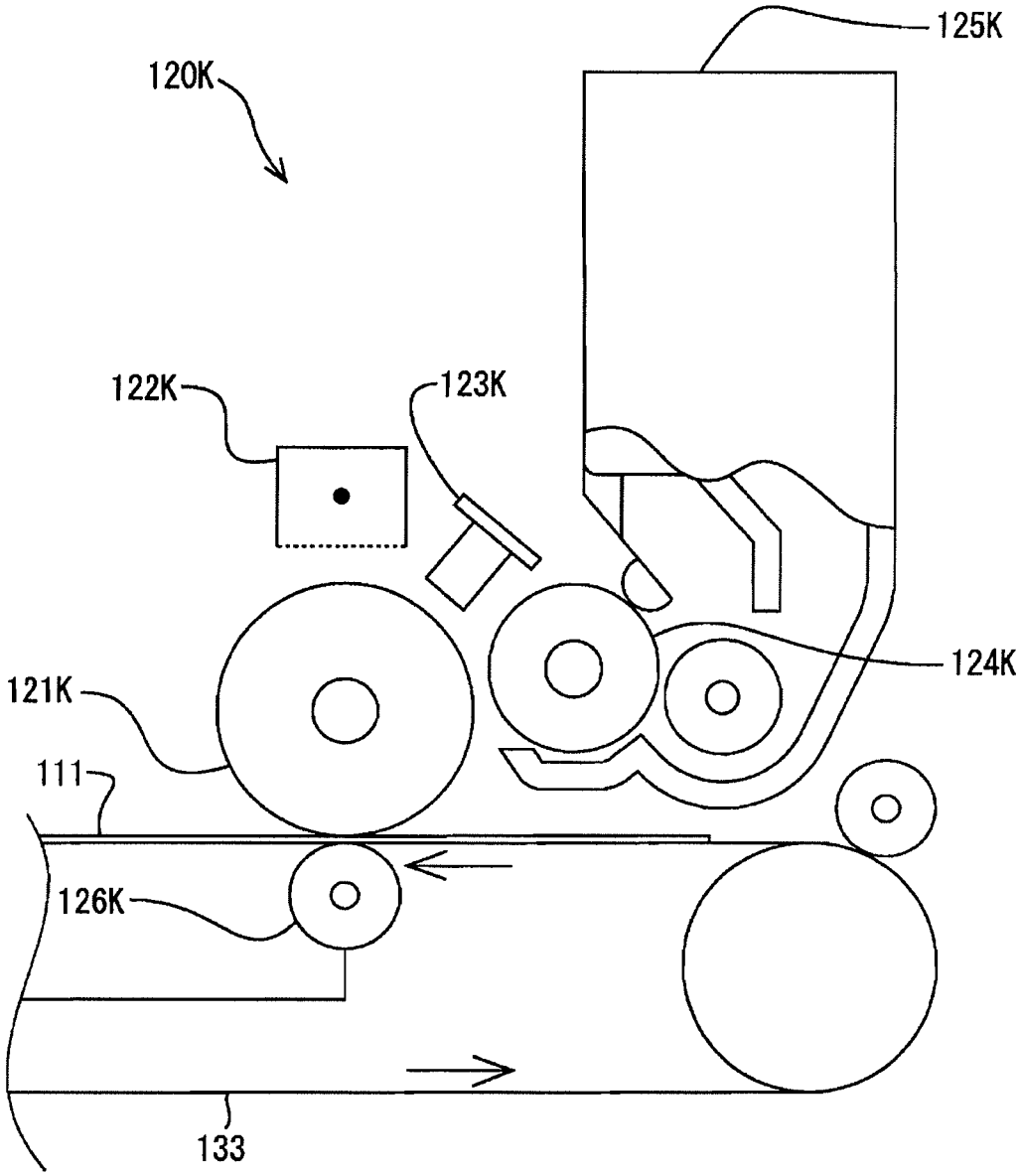
FIG. 2 is an enlarged view showing the configuration of an image formation unit of the printer.

FIG. 2 is an enlarged view showing the configuration of the image formation unit 120K of the printer 1 of this embodiment. Since the image formation units 120C, 120M, 120Y and 120K for the four colors CMYK have substantially the same configurations, only the image formation unit 120K will be explained below as a typical example. Incidentally, while the following explanation will be given about the image formation unit 120K (i.e. about one color K (black)), the following explanation applies also to the other colors (C (cyan), M (magenta) and Y (yellow)) and the other image formation units 120C, 120M and 120Y.

The image formation unit 120K includes a photosensitive drum 121K (example of a photosensitive body) which undergoes the charging process, a charging unit 122K for executing the charging process to the photosensitive 121K, an exposure unit 123K for executing the exposure process to the photosensitive drum 121K, a development roller 124K for executing the development process to the photosensitive drum 121K, a toner case 125K for storing a toner (black), and a transfer roller 126K for executing the image transfer process. With such a configuration, most of the electrophotographic processes (charging, exposure, development, image transfer) except the fixation process are executed.

When the image transfer process is finished for the black toner K through the above processes, subsequent image transfer processes for the other toners Y (yellow), M (magenta) and C (cyan) are successively executed to the sheet 111 (having a black toner image thereon) in the same way. When the image transfer process is completed for all toners K (black), Y (yellow), M (magenta) and C (cyan), the sheet 111 is fed to the fixation unit 140 (see FIG. 1) for the fixation process.

The fixation unit 140 executes the fixation process by heat-fixing the (multicolor) toner image on the sheet 111. When the heat fixing is finished, the sheet 111 is ejected onto the top of the printer 1, by which the printing is completed.

Figure 3:
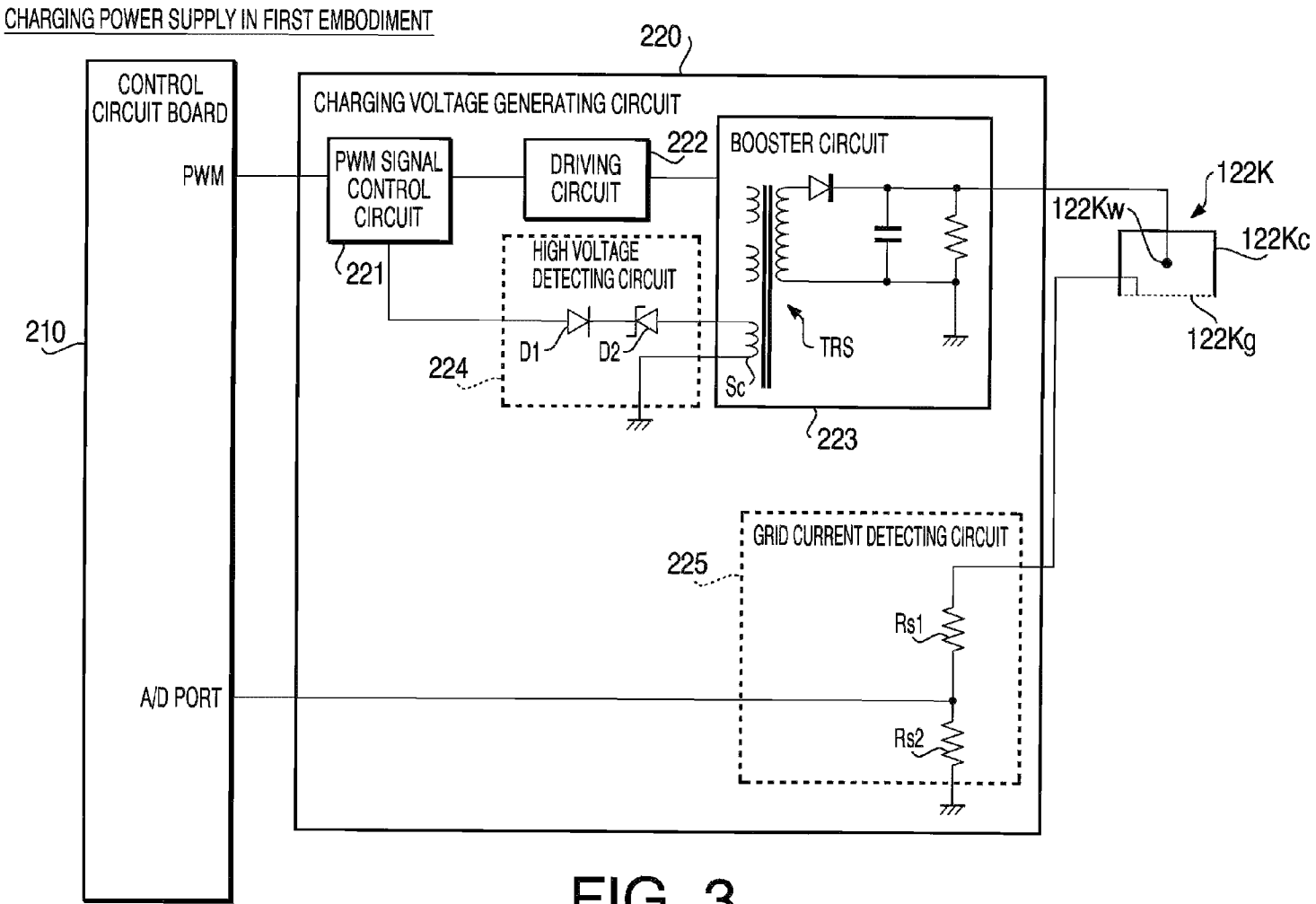
FIG. 3 is a schematic diagram showing the configuration of a charging mechanism and a power supply in accordance with a first embodiment of the present invention.

FIG. 3 shows the configuration of a charging mechanism and a power supply in accordance with a first embodiment of the present invention. The charging process (for the photosensitive drum 121K) is carried out by the charging unit 122K by electrically charging the surface of the photosensitive drum 121K (see FIG. 2) up to a positive electric potential (e.g. +700 V). The charging unit 122K includes a casing 122Kc, a charging wire 122Kw and a grid 122Kg which is placed at an opening of the casing 122Kc. The photosensitive drum 121K is frame-grounded (unshown) to a ground line (reference potential) of the printer 1.

The power supply (part of the high-voltage power supply 200 for supplying electric power to the charging unit 122K) includes a control circuit board 210 and a charging voltage generating circuit 220. The charging voltage generating circuit 220 is equipped with a PWM signal control circuit 221, a driving circuit 222, a booster circuit 223, a high voltage detecting circuit 224 and a grid current detecting circuit 225 (including two resistors Rs1 and Rs2).

The booster circuit 223 is capable of applying a high electric potential (approximately 7 kV) to the charging wire 122Kw. With the high electric potential, the charging wire 122Kw generates a corona discharge inside the casing 122Kc and thereby supplies electric charge to the grid 122Kg and the photosensitive drum 121K (80%-90% of the total electric charge to the grid 122Kg and 10%-20% to the photosensitive drum 121K).

Since the electric charge is supplied to the photosensitive drum 121K so that there is no potential difference between the grid 122Kg and the photosensitive drum 121K, the surface of the photosensitive drum 121K is evenly charged (at even electric potential) substantially at the electric potential of the grid 122Kg. Meanwhile, the grid 122Kg receives electric charge as an overflow of the electric charge already supplied to the photosensitive drum 121K.

The grid bias (electric potential of the grid 122Kg) is determined by the amount of the electric charge (per unit time) received by the grid 122Kg (grid current) and resistance values of the two resistors Rs1 and Rs2. In this embodiment, the grid bias is determined solely by the grid current since the resistance values of the resistors Rs1 and Rs2 are fixed.

Figure 4:
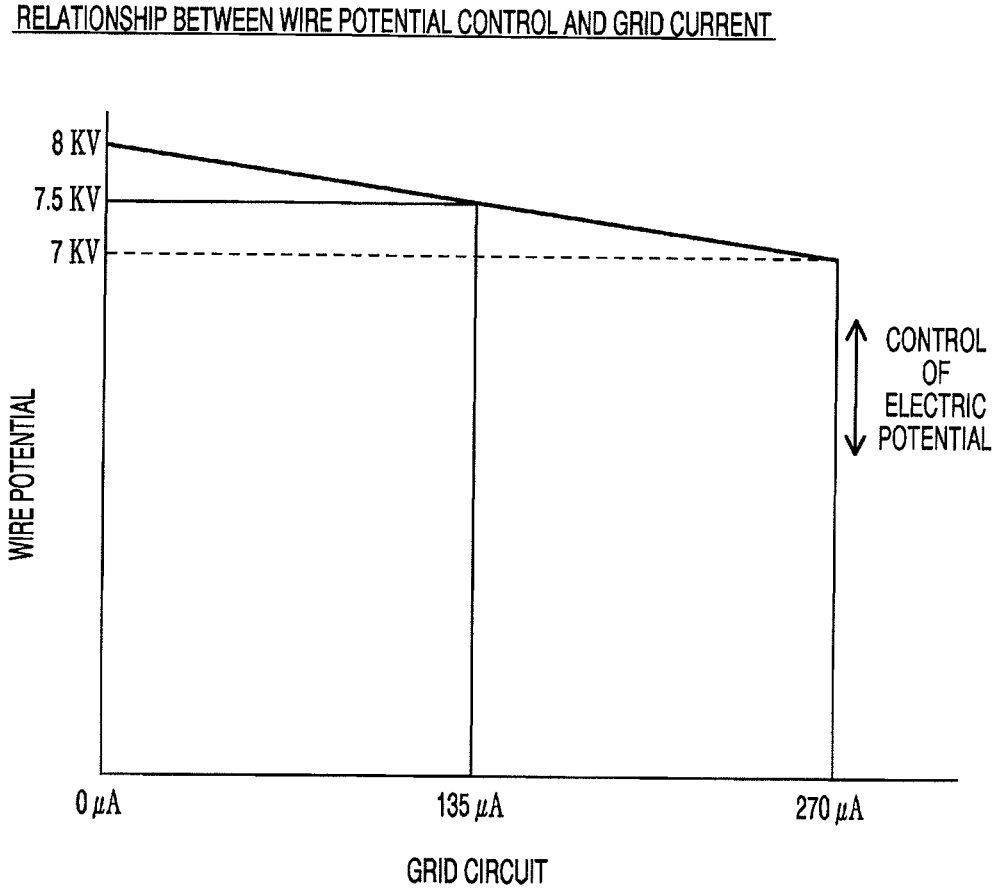
FIG. 4 is a graph for explaining the relationship between electric potential of a charging wire (wire potential) and grid current in the first embodiment.

FIG. 4 is a graph explaining the relationship between the electric potential of the charging wire 122Kw (wire potential) and the grid current in the first embodiment. The grid current is measured (calculated) by the control circuit board 210 based on an electric potential generated and outputted by the grid current detecting circuit 225. The control circuit board 210 controls the grid current to let it approach a fixed value (270 μA), by controlling the electric potential of the charging wire 122Kw (wire potential) based on the measured grid current.

As shown in FIG. 4, the wire potential can be freely controlled within the range between 0 kV and 7 kV. However, when the wire potential exceeds 7 kV, the wire potential is restricted within a preset upper limit even when the grid current drops. Specifically, the increase in the wire potential (due to a drop in the grid current) above 7 kV is not allowed without limitation. For example, even when the grid current drops from 270 μA to 135 μA, the increasing wire potential is restricted within 7.5 kV.

The upper limit of the wire potential is set as above since the increase in the wire potential without limitation can cause spark discharge from the charging wire 122Kw. In other words, the upper limit is set to the control range of the wire potential in order to prevent the spark discharge which can cause damage to the charging unit 122K and the surface of the photosensitive drum 121K (see FIG. 2).

Figure 5:
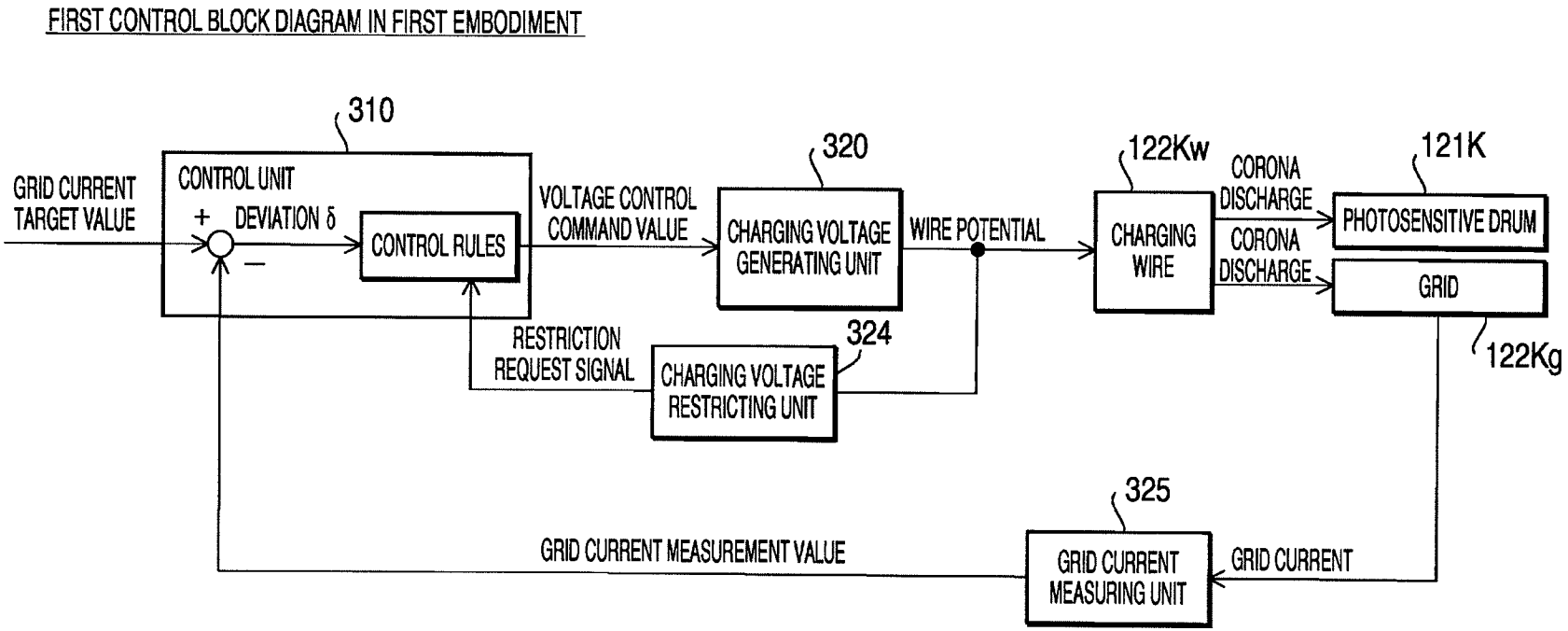
FIG. 5 is a first control block diagram in accordance with the first embodiment.

FIG. 5 is a first control block diagram in accordance with the first embodiment. The first control block diagram shows a first example of control that is implementable in the hardware configuration of the first embodiment. Since the block diagram is drawn as a functional block diagram, each block in the diagram does not necessarily correspond to each component of the hardware of the first embodiment in a one-to-one correspondence.

A control unit 310 calculates the deviation δ of the grid current (controlled variable) from the grid current target value (270 μA), generates a voltage control command value based on the calculated deviation δ according to prescribed control rules, and sends the voltage control command value to a charging voltage generating unit 320.

The charging voltage generating unit 320 generates an output electric potential to be supplied to the charging wire 122Kw (as the wire potential) based on the voltage control command value. The wire potential (output electric potential) is monitored by a charging voltage restricting unit 324. The charging voltage restricting unit 324 outputs a restriction request signal to the control unit 310 when a wire potential exceeding 7 kV is detected.

In this example, the function of the control unit 310 is implemented by the control circuit board 210 and the PWM signal control circuit 221 (see FIG. 3). The function of the charging voltage generating unit 320 is implemented by the driving circuit 222 and the booster circuit 223. The function of the charging voltage restricting unit 324 is implemented by the high voltage detecting circuit 224.

The charging wire 122Kw generates a corona discharge and thereby supplies electric charge to the grid 122Kg and the photosensitive drum 121K. The electric current supplied to the grid 122Kg is measured by a grid current measuring unit 325. The output of the grid current measuring unit 325 (grid current measurement value) is fed back to the control unit 310. In this example, the function of the grid current measuring unit 325 is realized by use of the grid current detecting circuit 225.

As above, the control system shown in FIG. 5 is configured as a constant-current feedback control system which keeps the grid current (controlled variable) at a constant level by controlling the wire potential. Meanwhile, since grid potential (electric potential of the grid) is also fixed at a constant level in this control system when the grid current is constant, the control system can be regarded as a system configured to keep the grid current and the grid potential at constant levels.

However, when the wire potential exceeds 7 kV as mentioned above in the control of the wire potential, the control in this control system is switched from the constant-current feedback control (keeping the grid current at a constant level) to potential control (restricting the increase in the wire potential while allowing a drop in the grid current) (see FIG. 4). The wire potential exceeding 7 kV is detected by the high voltage detecting circuit 224.

The high voltage detecting circuit 224 (see FIG. 3) is implemented in a simple configuration including a diode D1 and a Zener diode D2 which is connected in series and in reverse polarity to the diode D1. The Zener diode D2 is grounded via a sensing coil Sc included in a transformer TRS of the booster circuit 223. The diode D1 is connected to the PWM signal control circuit 221.

Since the diode D1 and the Zener diode D2 in the high voltage detecting circuit 224 (see FIG. 3) are connected in series and in reverse polarities, the high voltage detecting circuit 224 outputs no voltage until the output voltage of the sensing coil Sc reaches the breakdown voltage of the Zener diode D2. After the output voltage of the sensing coil Sc has reached the breakdown voltage of the Zener diode D2, the high voltage detecting circuit 224 outputs the output voltage of the sensing coil Sc directly to the PWM signal control circuit 221. The wire turns (number of turns) of the sensing coil Sc has been set so that its output reaches the breakdown voltage of the Zener diode D2 when the wire potential reaches 7 kV.

In other words, whether the wire potential has exceeded 7 kV (threshold value) or not can be detected by the Zener diode D2. Thus, the monitoring on whether the wire potential has exceeded 7 kV or not can be implemented with a simple configuration.

As above, the control system in the first embodiment controls the grid current (grid potential) as the controlled variable so as to keep it at a constant level by controlling the wire potential when the wire potential is within 7 kV, while executing the control allowing a drop in the grid current (grid potential) by setting the upper limit to the control range of the wire potential when the wire potential exceeds 7 kV due to contamination, etc. of the charging wire 122Kw. By the control, the printing can be continued normally while preventing the spark discharge caused by the excessive increase in the wire potential.

Figure 6:
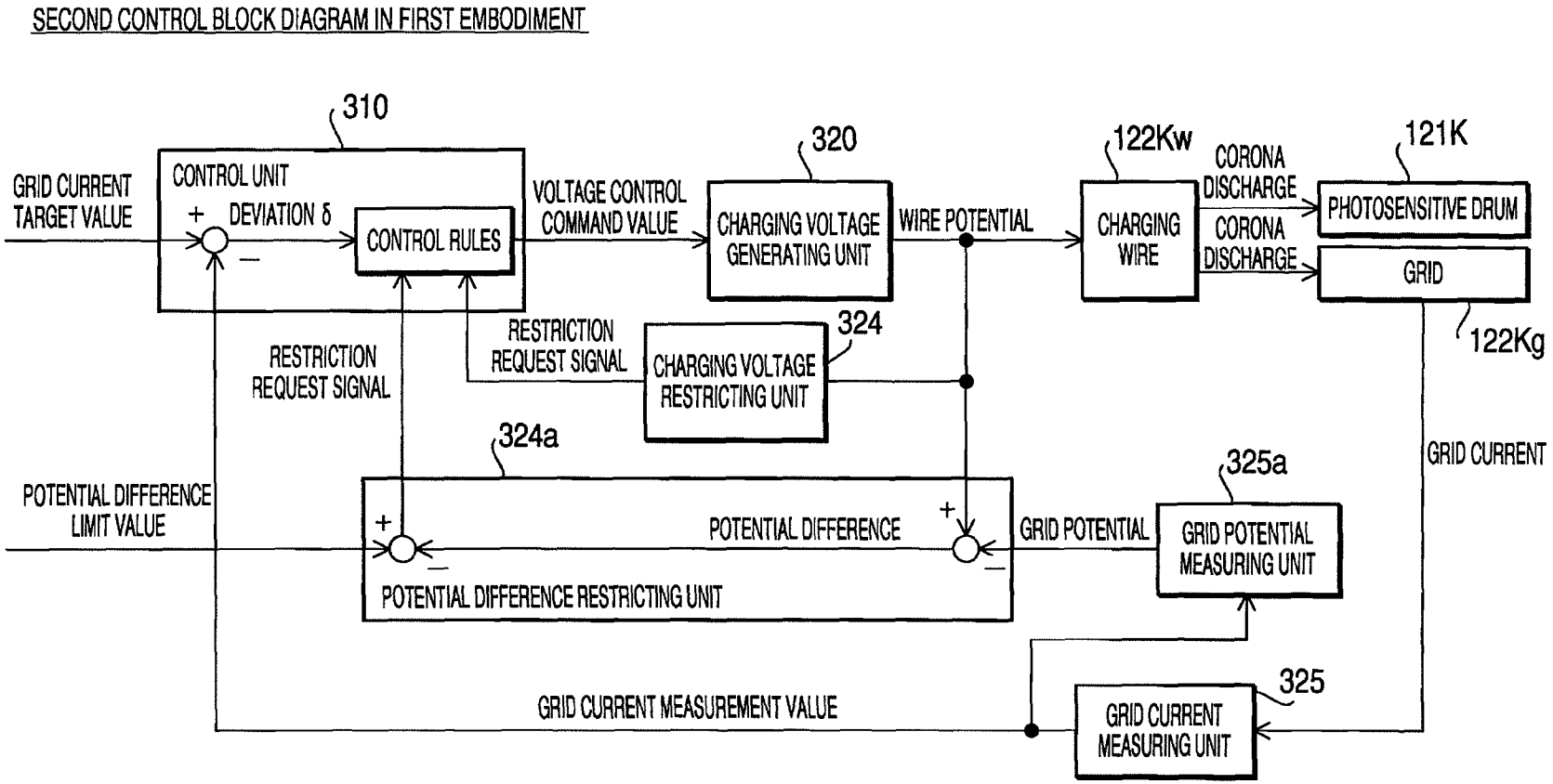
FIG. 6 is a second control block diagram in accordance with the first embodiment.

FIG. 6 is a second control block diagram in accordance with the first embodiment. The second control block diagram (FIG. 6) differs from the first control block diagram (FIG. 5) in that extra restriction based on the potential difference between the wire potential and the grid potential is made in addition to the aforementioned upper limit to the control range of the wire potential. Such restriction is implemented by a grid potential measuring unit 325*a* and a potential difference restricting unit 324*a* in this example.

The grid potential measuring unit 325*a* measures (calculates) the grid potential based on the grid current measurement value outputted by the grid current measuring unit 325. The potential difference restricting unit 324*a* calculates the potential difference between the wire potential and the grid potential and sends the restriction request signal to the control unit 310 when the calculated potential difference exceeds a potential difference limit value which has been set previously. The function of the grid potential measuring unit 325*a* may be implemented by the control circuit board 210, for example. The function of the potential difference restricting unit 324*a* may be implemented by the control circuit board 210, an electronic circuit employing a comparator (unshown), etc.

As above, the second control system in accordance with the first embodiment (in which the extra restriction based on the potential difference between the wire potential and the grid potential is made) is further capable of preventing spark discharge that is caused by a drop in the grid potential due to a drop in the grid current, for example. This configuration has been created based on the present inventor's idea that the spark discharge can be caused not only by an excessive increase in the wire potential but also by a drop in the grid potential.

With this configuration, the spark discharge caused by an excessive potential difference between the wire potential and the grid potential can be prevented while also eliminating the need of setting the upper limit of the wire potential in anticipation of a drop in the grid potential. Consequently, the second control system has an extra advantage in that the system can maintain normal printing by the printer 1 for a longer time compared to the first control system while preventing the spark discharge by raising the upper limit of the wire potential.

While the grid current is measured by the grid current measuring unit 325 and the grid potential is calculated by the grid potential measuring unit 325*a* based on the grid current measured by the grid current measuring unit 325 in the example of FIG. 6, the grid current and the grid potential may also be measured directly, that is, the grid potential measuring unit 325*a* may be configured to directly measure the grid potential. It is also possible to configure the grid current measuring unit 325 to calculate the grid current based on the grid potential directly measured by the grid potential measuring unit 325*a*.

Figure 7:
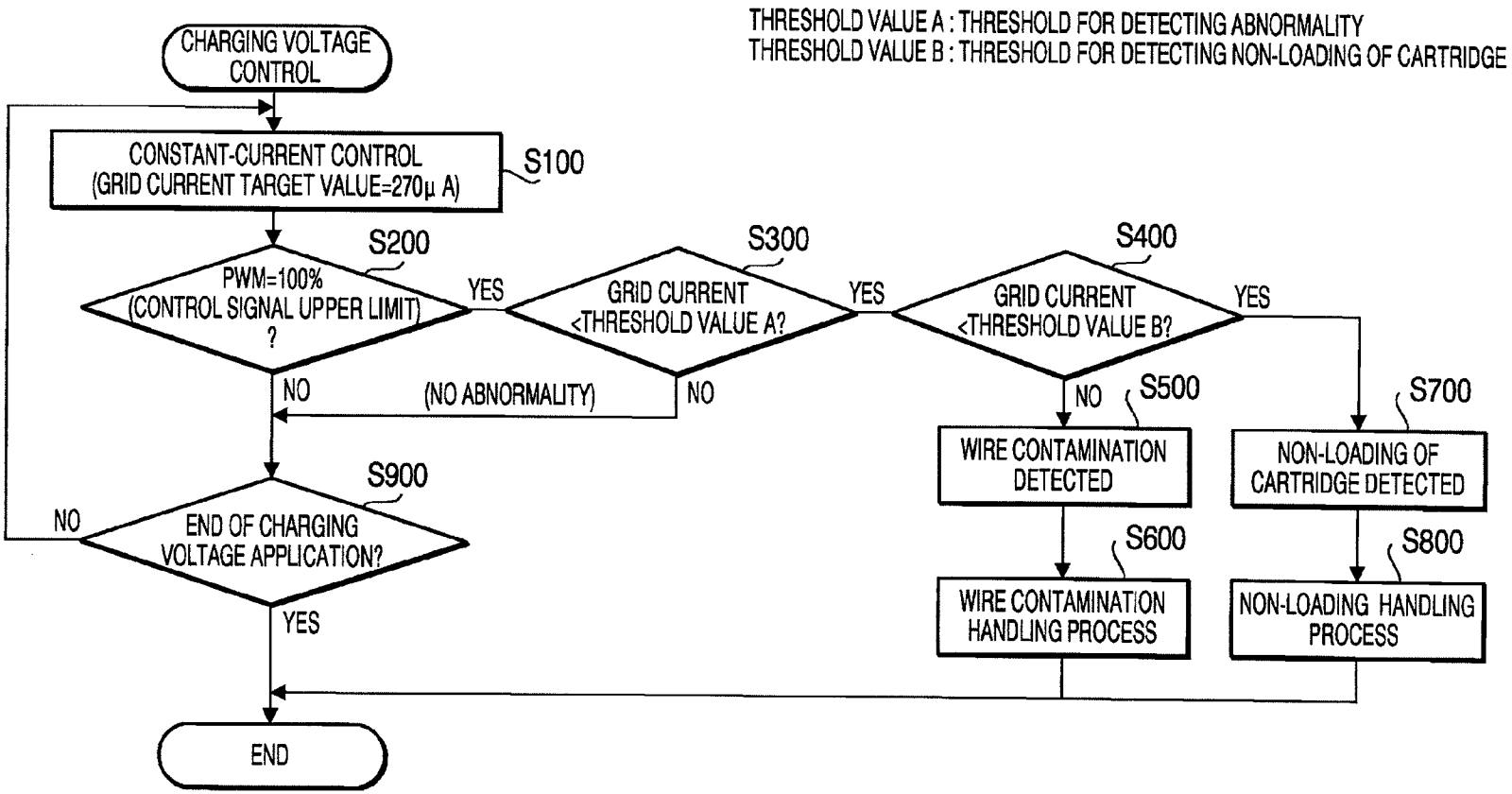
FIG. 7 is a flowchart showing a routine which implements a wire abnormality detecting method in accordance with the first embodiment.

FIG. 7 is a flowchart showing a routine which implements a wire abnormality detecting method in accordance with the first embodiment. This wire abnormality detecting method resolves a new problem that the wire potential is unusable for the detection of abnormality since the increase in the wire potential is restricted even when the corona discharge from the charging wire 122Kw is hampered by the contamination, etc. of the charging wire 122Kw. The wire abnormality detecting method has been created focusing on the fact that the contamination, etc. of the charging wire 122Kw can be detected from a drop in the grid current even when the increase in the wire potential is restricted. The high-voltage power supply 200 starts executing a charging voltage control process shown in FIG. 7 when the printer 1 powered on.

In step S100, the control circuit board 210 and the charging voltage generating circuit 220 execute constant-current control so as to let the grid current approach the grid current target value (270 μA). Incidentally, this control is configured so that a PWM (Pulse-Width Modulation) signal (see FIG. 3) reaches its upper limit (duty ratio=100%) at the upper limit of the control range of the wire potential. This control has an advantage in that the charging voltage generating circuit 220 has the fail-safe property since the wire potential does not exceed the upper limit of the control range even when abnormality occurs in the control circuit board 210.

In the next step 200, the control circuit board 210 judges whether the PWM signal has reached its upper limit (duty ratio=100%). If the PWM signal has not reached the upper limit (S200: NO), the process advances to step S900 and the operation of the printer 1 is continued. If the PWM signal has reached the upper limit (S200: YES), the process advances to step S300.

In the step S300, the control circuit board 210 judges whether the grid current is less than a preset threshold value A. The threshold value A is used for judging whether the contamination, etc. of the charging wire 122Kw has reached a level at which cleaning has to be requested.

If the grid current is the preset threshold value A or more (S300: NO), that is, when the cleaning is unnecessary (no abnormality), the process advances to the step S900 and the operation of the printer 1 is continued. If the grid current is less than the preset threshold value A (S300: YES), the process advances to step S400.

In the step S400, the control circuit board 210 judges whether the grid current is less than a preset threshold value B. The threshold value B is used for judging whether the drop in the grid current was caused by not loading a cartridge (unshown) including the toner case 125K.

If the grid current is less than the preset threshold value B (S400: YES), the control circuit board 210 judges that the cartridge has not been loaded (S700) and advances to step S800. If the grid current is the preset threshold value B or more (S400: NO), the control circuit board 210 judges that the cleaning of the charging wire 122Kw is necessary (S500) and advances to step S600.

In the step S600, the control circuit board 210 requests the user to clean the charging wire 122Kw and stops the operation of the printer 1 (wire contamination handling process). On the other hand, in the step S800, the control circuit board 210 requests the user to load the cartridge and stops the operation of the printer 1 (non-loading handling process).

As above, by the wire abnormality detecting method in accordance with the first embodiment, the contamination, etc. of the charging wire 122Kw (reaching the level at which the cleaning of the charging wire 122Kw has to be requested) can be detected based on the grid current instead of the wire potential whose control range is restricted.

Incidentally, setting the threshold value A strictly (i.e. at a small value) makes it possible to previously inform the user that the cleaning of the charging wire 122Kw will become necessary soon. With this configuration, the need of cleaning the charging wire 122Kw can previously be reported to the user while also preventing the spark discharge by the above control method and realizing a longer operating time of the printer 1. Thus, the operability and usability of the printer 1 can be increased remarkably through the prevention of sudden stoppages of the printer's operation and the extension of the operating time.

In the above wire abnormality detecting method, the judgment on whether the charging wire 122Kw has been contaminated or not is made by comparing the grid current (having high correlation with the charging unit's ability to supply electric charge to the photosensitive drum 121K) with the threshold value B. Thus, the judgment on the contamination of the charging wire 122Kw can be made with reference to (based on) the charging unit's ability to supply electric charge to the photosensitive drum 121K. Since the grid current is a current value manifesting the amount of electric charge received (per unit time) by the grid 122Kg as an overflow of the electric charge supplied to the photosensitive drum 121K, the grid current is a physical quantity suitable for the judgment on whether a sufficient amount of electric charge is being supplied by the corona discharge. On the other hand, since the supply of electric charge by the corona discharge is blocked by the contamination of the charging wire 122Kw, the judgment on the contamination of the charging wire 122Kw can be made with high reliability by making the judgment based on the grid current.

Figure 8:
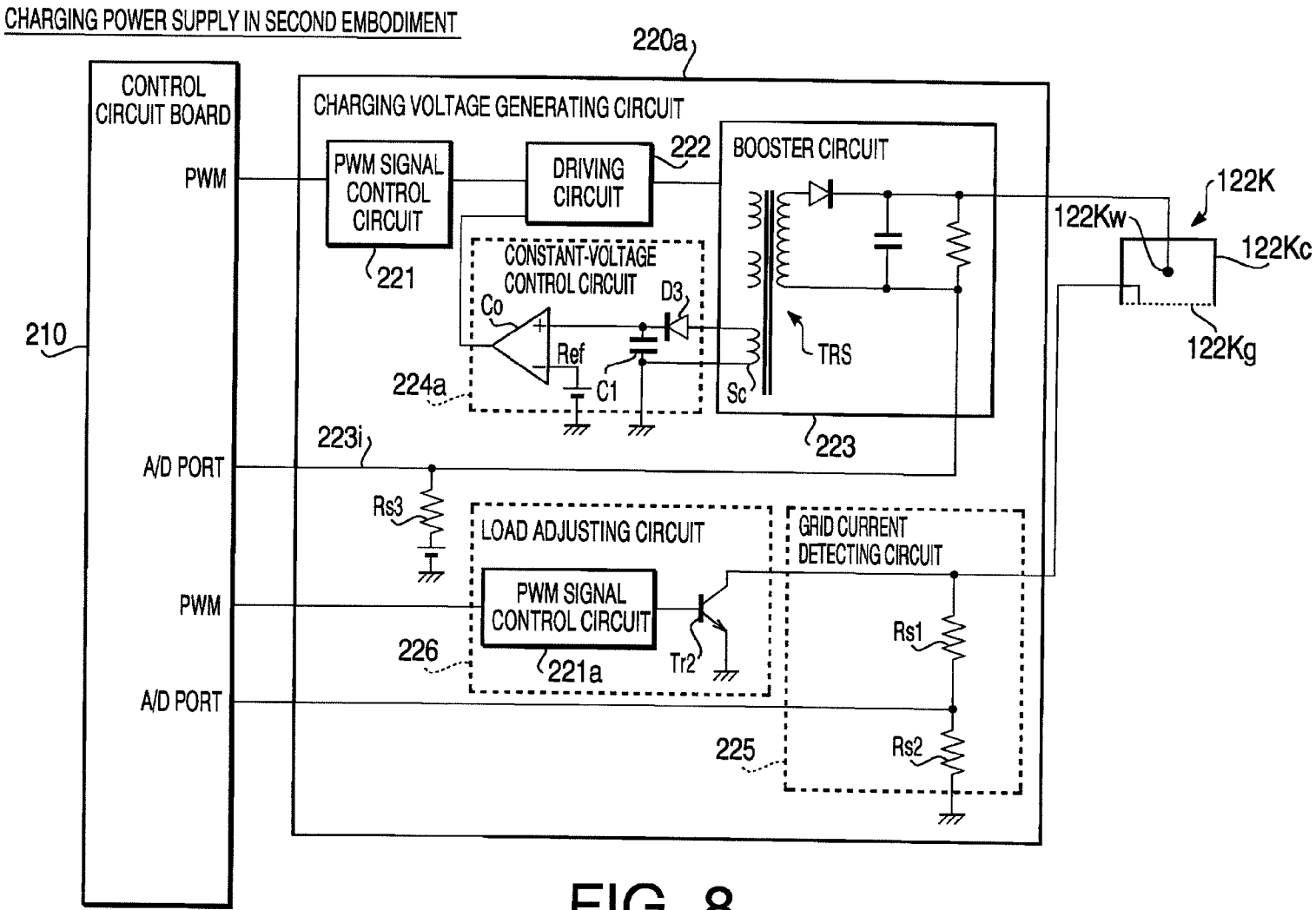
FIG. 8 is a schematic diagram showing the configuration of a charging mechanism and a power supply in accordance with a second embodiment of the present invention.

FIG. 8 is a schematic diagram showing the configuration of a charging mechanism and a power supply in accordance with a second embodiment of the present invention. The second embodiment has substantially the same configuration as the first embodiment except that a charging voltage generating circuit 220*a* is employed instead of the charging voltage generating circuit 220 in the first embodiment.

The charging voltage generating circuit 220*a* differs from the charging voltage generating circuit 220 in the first embodiment in that it further includes a load adjusting circuit 226, a constant-voltage control circuit 224*a* is employed instead of the high voltage detecting circuit 224 in the first embodiment (FIG. 3), and the configuration for grounding the booster circuit 223 is different from that in the first embodiment. The configuration for grounding the booster circuit 223 includes a measurement line 223*i* and a sensing resistor Rs2 in order to measure wire current supplied to the charging wire 122Kw. To the measurement line 223*i*, bias voltage is applied.

Figure 9:
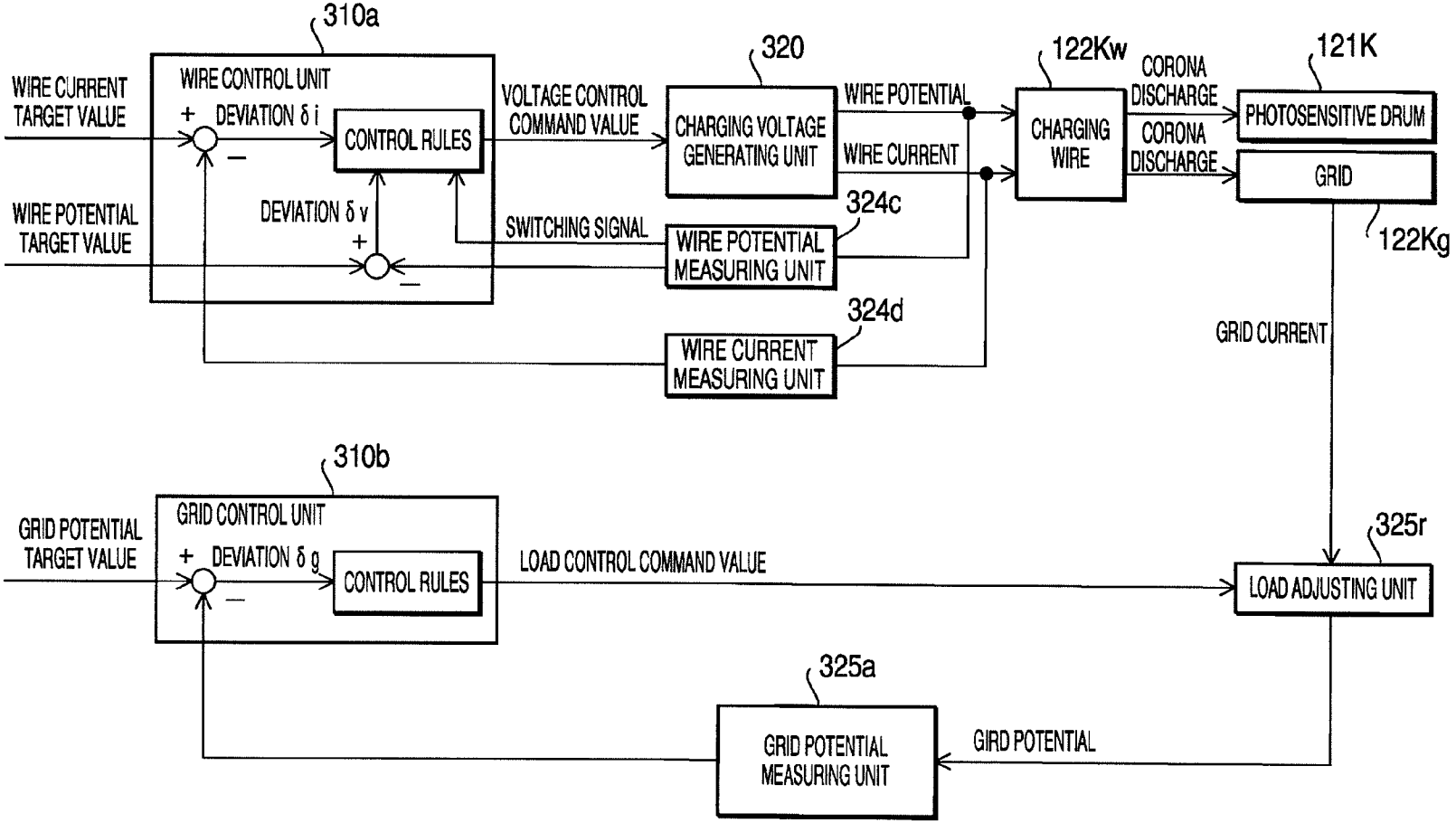
FIG. 9 is a control block diagram in accordance with the second embodiment.

FIG. 9 is a control block diagram in accordance with the second embodiment. This control system differs from the two control systems in the first embodiment in that the wire current (or wire potential) and the grid potential can be controlled independently.

The control system of the second embodiment includes a wire control unit 310*a* which controls the electric potential and electric current of the charging wire 122Kw and a grid control unit 310*b* which controls the grid potential. The wire control unit 310*a* and the grid control unit 310*b* are capable of executing the control independently of each other.

The wire control unit 310*a* is capable of executing the control in two control modes: a wire constant-current control mode and a wire constant-potential control mode. The wire constant-current control mode is the default control mode (initial setting). The wire constant-potential control mode is a control mode that is used when the electric potential of the charging wire 122Kw has exceeded a prescribed threshold value (e.g. 7 kV) due to contamination, etc. of the charging wire 122Kw. Whether the electric potential of the charging wire 122Kw has exceeded the threshold value or not is detected by a wire potential measuring unit 324*c*.

In the wire constant-current control mode, the wire control unit 310*a* calculates the deviation δi of the wire current (controlled variable) from a wire current target value (e.g. 3000 μA), generates the voltage control command value based on the calculated deviation δi according to prescribed control rules, and sends the voltage control command value to the charging voltage generating unit 320. The wire current is measured by use of the measurement line 223*i* and the sensing resistor Rs3 in this embodiment.

The charging voltage generating unit 320 generates an output electric potential to be supplied to the charging wire 122Kw (as the wire potential) according to the voltage control command value. To the charging wire 122Kw, discharge current corresponding to the electric charge supplied to the photosensitive drum 121K and the grid 122Kg per unit time is supplied according to the output electric potential and the discharging load of the charging wire 122Kw. The discharge current is measured by a wire current measuring unit 324*d* and fed back to the wire control unit 310*a*.

One characteristic of the wire constant-current control mode (in which the discharge current is controlled to be at a target value (constant)) is that the discharge current does not change even when the discharging load changes due to contamination of the charging wire 122Kw or environmental changes (in atmospheric pressure, humidity, etc.). With such a characteristic, the wire constant-current control mode has an advantage in that it can suppress variations in the surface electric potential of the photosensitive drum 121K and thereby maintain high image quality even when the discharging load changes. However, the wire constant-current control mode involves a problem in that an excessive change in the discharging load (due to serious contamination of the charging wire 122Kw, etc.) can lead to a great change in the discharge voltage (wire potential) and that can cause spark discharge.

Such a problem is resolved in this embodiment by the switching of the control mode of the wire control unit 310*a* from the wire constant-current control mode to the wire constant-potential control mode in response to the detection of an excessive change in the discharging load. In this embodiment, the excessive change in the discharging load is detected by the wire potential measuring unit 324*c* by judging whether the electric potential of the charging wire 122Kw has exceeded a prescribed threshold value. In response to the detection, the wire potential measuring unit 324*c* sends a control mode switching signal to the wire control unit 310*a* and thereby makes the wire control unit 310*a* switch its control mode to the wire constant-potential control mode.

The wire constant-potential control mode, in which the discharge voltage is controlled to be at a target value (constant), has an advantage in that a configuration capable of preventing the spark discharge can be implemented with ease by properly setting the target value. However, compared to the wire constant-current control mode, the wire constant-potential control mode has a disadvantage in that the surface electric potential of the photosensitive drum 121K can change due to contamination of the charging wire 122Kw or environmental changes (in atmospheric pressure, humidity, etc.) and that can cause deterioration of the image quality.

The function of the wire potential measuring unit 324*c* is implemented by the constant-voltage control circuit 224*a* in this embodiment. The constant-voltage control circuit 224*a* includes a smoothing circuit (having a diode D3 and a capacitor C1) and a comparator Co. The smoothing circuit is grounded via the sensing coil Sc included in the transformer TRS of the booster circuit 223.

The comparator Co compares output electric potential of the smoothing circuit with a reference potential Ref and sends a detection signal to the driving circuit 222 when the output electric potential is higher than the reference potential Ref. In this example, the control is executed so as to reduce the driving current from the driving circuit 222 in response to the detection signal (indicating that the electric potential of the charging wire 122Kw has exceeded the prescribed threshold value), by which output electric potential of the booster circuit 223 is restricted within an upper limit, which substantially implements the constant-voltage control mode (wire constant-potential control mode).

Incidentally, the switching of the control mode to the constant-voltage control mode (wire constant-potential control mode) may also be implemented by switching the driving logic or software inside the control circuit board 210 by inputting the output of the constant-voltage control circuit 224*a* to the control circuit board 210, for example.

As above, the wire control unit 310*a* in the second embodiment executes the control in the wire constant-current control mode (capable of maintaining high image quality against the variations in the discharging load) in a state in which the contamination, etc. of the charging wire 122Kw is slight, while executing the control in the wire constant-potential control mode (suitable for preventing the spark discharge) in a state in which the contamination, etc. of the charging wire 122Kw is excessive. Thus, control capable of achieving both high image quality and the prevention of the spark discharge can be realized taking advantage of the characteristics of the wire constant-current control mode and the wire constant-potential control mode.

Here, the "state in which the contamination, etc. of the charging wire 122Kw is slight means a state in which the occurrence of the spark discharge can not be expected, and the "state in which the contamination, etc. of the charging wire 122Kw is excessive" means a state in which the occurrence of the spark discharge can be expected.

Meanwhile, the grid control unit 310*b* (see FIG. 9) controls the grid potential by controlling the resistance between the grid 122Kg and the ground. The control of the resistance is implemented by the load adjusting unit 325*r*. The grid potential is measured by the grid potential measuring unit 325*a* and fed back to the grid control unit 310*b*. The function of the load adjusting unit 325*r* is implemented by the load adjusting circuit 226 (see FIG. 8) in this embodiment.

The load adjusting circuit 226 includes an NPN transistor Tr2 and a PWM signal control circuit 221*a* which drives the transistor Tr2. The collector of the transistor Tr2 is connected to the grid 122Kg, while the emitter is grounded. The PWM signal control circuit 221*a*, which is connected to the base of the transistor Tr2, is capable of making the transistor Tr2 function as a variable resistor.

Since the load adjusting circuit 226 is connected in parallel with the grid current detecting circuit 225 (which functions substantially as a grid potential detecting circuit), the load adjusting circuit 226 is capable of controlling the grid potential (by controlling the resistance between the grid 122Kg and the ground) without impairing the grid potential detecting function of the grid current detecting circuit 225.

As above, even when the grid current changes, the grid control unit 310*b* is capable of implementing the constant-voltage control (keeping the grid potential at a constant electric potential) by controlling the resistance between the grid 122Kg and the ground.

Since the grid load (load against the grid current) is adjusted as above, the wire potential and the grid potential can be controlled independently with a simple configuration.

Incidentally, while the control mode is switched from the wire constant-current control mode to the wire constant-potential control mode in the second embodiment, the control mode may also be switched from the grid constant-current control mode (in the first embodiment) to the wire constant-potential control mode or set in the wire constant-potential control mode from the beginning, for example.

Especially, the configuration switching the control mode from the grid constant-current control mode to the wire constant-potential control mode has an advantage in that control capable of achieving both high image quality and the prevention of the spark discharge can be realized taking advantage of the characteristics of both control modes by executing the control in the grid output control mode (grid constant-current control mode) (capable of maintaining high image quality against the variations in the discharging load) in the state in which the contamination, etc. of the charging wire is slight while executing the control in the wire constant-potential control mode (suitable for preventing the spark discharge) in the state in which the contamination, etc. of the charging wire is excessive.

While the grid potential is controlled by controlling the resistance between the grid 122Kg and the ground in the second embodiment, it is also possible to employ a grid power supplying circuit (unshown) which supplies electric power to the grid 122Kg and a grid power supply control circuit (unshown) which controls the grid potential to be at a constant level by controlling the grid power supplying circuit. The grid power supplying circuit and the grid power supply control circuit may also be employed in addition to the control of the resistance between the grid 122Kg and the ground.

With this configuration (in which the grid current can be supplied to the grid 122Kg from the outside of the charging unit 122K), electric current from the charging wire 122Kw to the grid 122Kg can be reduced while also stabilizing the grid potential, by which the supply of the electric charge to the photosensitive drum 121K can be stabilized further.

Figure 10:
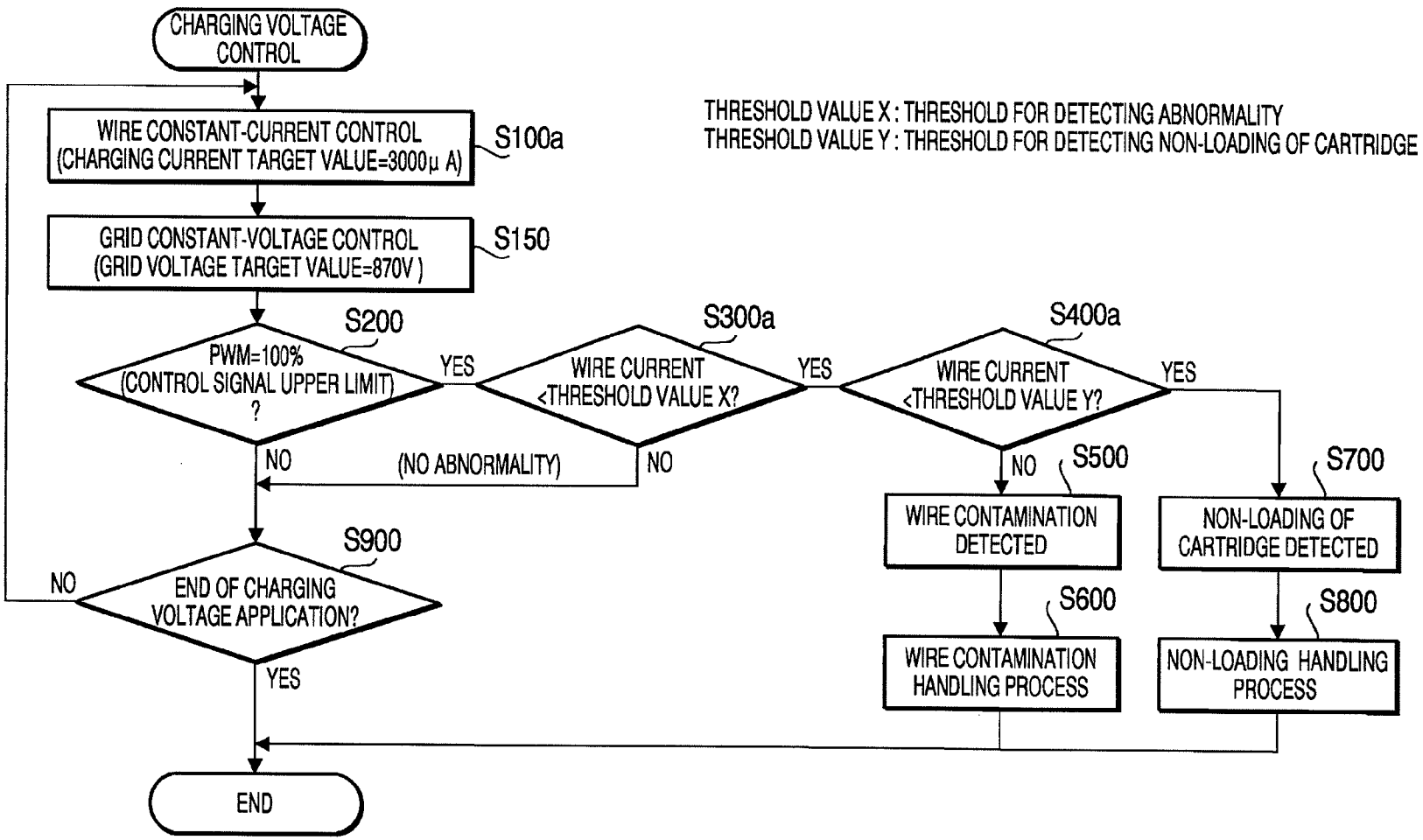
FIG. 10 is a flowchart showing a routine which implements a wire abnormality detecting method in accordance with the second embodiment.

FIG. 10 is a flowchart showing a routine which implements a wire abnormality detecting method in accordance with the second embodiment. This wire abnormality detecting method differs from that in the first embodiment in that a new step S150 is added and the steps S100, S300 and S400 in the first embodiment are replaced with steps S100*a*, S300*a* and S400*a*, respectively.

The step S100*a* differs from the step S100 in the first embodiment (employing the grid current as the controlled variable) in that the wire current is employed as the controlled variable. Incidentally, the switching of the control mode to the constant-voltage control mode (wire constant-potential control mode) by the wire control unit 310*a* is left out in the example of FIG. 10 for the clarity of explanation.

In the step S150 (grid constant-voltage control), the grid potential is controlled by controlling the resistance between the grid 122Kg and the ground. In this control, the electric potential at the detecting point of the grid current detecting circuit 225 does not change even when the discharging load increases due to contamination, etc. of the charging wire 122Kw, and thus the abnormality detection can not be made based on variations in the electric potential at the detecting point of the grid current detecting circuit 225 as in the first embodiment. Incidentally, the variations in the electric potential at the detecting point of the grid current detecting circuit 225 is handled as variations in the grid current in the first embodiment.

Since the abnormality detection can not be made based on the electric potential variations at the detecting point of the grid current detecting circuit 225 in this control system, the abnormality detection is made in the steps S300*a* and S400*a* based on the wire current instead of the grid current.

In the step S300*a*, the control circuit board 210 judges whether the wire current is less than a preset threshold value X. The threshold value X is used for judging whether the contamination, etc. of the charging wire 122Kw has reached the level at which the cleaning has to be requested.

As above, by the wire abnormality detecting method in accordance with the second embodiment, excessive contamination, etc. of the charging wire 122Kw can be detected based on the wire current instead of the grid current or the wire potential whose control range is restricted.

While a description has been given above of preferred embodiments in accordance with the present invention, the present invention is not to be restricted by the particular illustrative embodiments and a variety of modifications, design changes, etc. are possible without departing from the scope of the present invention described in the appended claims.

While reversion of the control rules (after the control rules (including the control mode) are changed when the wire potential exceeds a prescribed electric potential) is not assumed in the above embodiments, the control rules may be reverted to the initial control rules when the power of the printer 1 is turned OFF, when a prescribed time period has passed, etc. since there are cases where the increase in the discharging load (due to contamination, etc. of the charging wire) is a temporary increase.

While a control circuit employing a control circuit board and electronic circuits has been described as an example of a control system in each of the above embodiments, the control system in each embodiment may also be implemented by one or more electronic circuits capable of implementing the control system, by a computer (CPU, memory, software), or by a combination of a computer and one or more electronic circuits.

In each of the above-described embodiments, the charging voltage generating circuit 220 increases the grid current as the duty ratio of the PWM signal increases. Alternatively, in each of the above-described embodiments, the charging voltage generating circuit 220 may decrease the grid current as the duty ratio of the PWM signal decreases.

In each of the above-described embodiments, a case where the charging voltage generating circuits 220 and 220*a* are activated when the contamination of the wire is significant is not assumed. However, each embodiment may be modified such that, even if the charging voltage generating circuits 220 and 220*a* are activated when the contamination of the wire is significant, occurrence of the spark discharge is prevented in advance.

As described above, when the contamination of the charging wire 122Kw occurs, the impedance of the charging wire 122Kw increases and the grid current is lowered. Therefore, the control unit 310 transmits a voltage handling command value to the charging voltage generating unit 320 to increase the wire potential. In accordance with the progress of the contamination of the charging wire 122Kw, the wire potential gradually increases. When the wire potential exceeds a prescribed level, the spark discharge occurs. If, however, the above-described first embodiment is applied, the spark discharge can be prevented in advance.

If, however, the contamination of the charging wire 122Kw has been proceeded significantly when the high-voltage power supply 200 is activated, the PWM signal control circuit 221 strengthen the PWM signal so that the grid current is equal to the target value. Further, the PWM signal control circuit 221 increase an increment of the PWM signal since the increment ratio of the grid current is low in comparison with a case where the contamination of the charging wire has not been progressed so much. Therefore, if the response speed of the charging voltage restricting unit 324 is not so high, the wire potential overshoots and the spark discharge will possibly occur. In order to prevent the overshoot of the wire potential, the increment of the PWM signal may be made small and control the grid current to decrease gradually and reach the target value. However, such a method requires a relatively long time until the grid current reaches the target value, which may become one of the causes of delay of image formations.

According to a third embodiment described hereinafter, when the high-voltage power supply 200 is powered on, a delay of a rising period (i.e., a time period in which the grid current etc. reaches target values) is suppressed, while the spark discharge is well suppressed.

Hereinafter, the charging voltage control process according to the third embodiment, which is a modification of the first embodiment, will be described with reference to a flowchart shown in FIG. 11 and a chart shown in FIG. 12.

The charging voltage control process is initiated by the control unit 310 (on the control substrate 210) when the high-voltage power supply 200 is activated. Specifically, when the printer 1 is powered on, when an image formation request is input through the operation unit of the printer 1 or from an external device, or when the operational status of the printer 1 is changed from a power save mode to a normal operation mode, the bight-voltage power supply 200 is activated.

Figure 13:
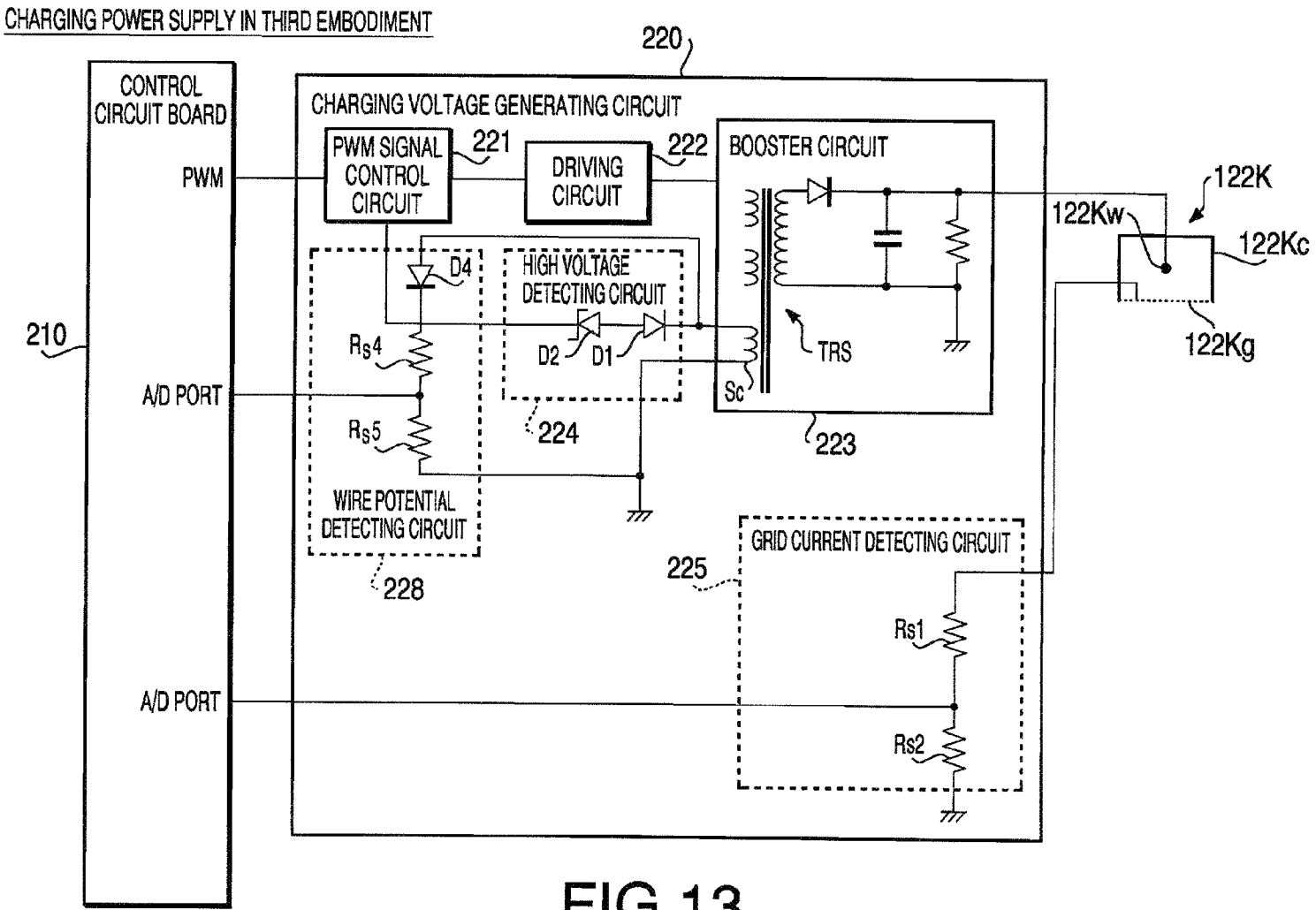
FIG. 13 is a schematic diagram showing the configuration of a charging mechanism and a power supply in accordance with the third embodiment.

The control unit 310 controls the PWM signal control circuit 221 to generate a pulse width modification signal PWM 1 (e.g., having a duty ratio of 30%) in S1. Then, the control unit 310 pauses for a predetermined period (e.g., 50 ms) in S3. Thereafter, the control unit 310 measures a grid current Ig1 and a wire potential Vc1 (S5). For example, the grid current may be 50 μA and the wire potential Vc1 may be 2.7 kV. As shown in a block diagram of FIG. 13, the wire potential Vc1 is measured with use of a wire potential detecting circuit 228 having a diode D4 and two resistors Rs4 and Rs5.

The control unit 310 controls the PWM signal control circuit 221 to generate a pulse width modification signal PWM2 (e.g., having a duty ratio of 50%) in S7, and pauses for a predetermined period (e.g., 50 ms) in S9. Thereafter, the control unit 310 measures a grid current Ig2 and a wire potential Vc2 in S11. For example, at this stage, the gird current may be 150 μA and the wire potential may be 4.8 kV.

In S13, the control unit 310 calculates a predictable potential Vc_it (e.g., 7.3 kV) which would be a potential when the grid current Ig reaches the final target current Ig_tg, based on the grid current Ig1 and wire potential Vc1 measured in S5 and the grid current Ig2 and wire potential Vc2 measured in S11.

Figure 12:
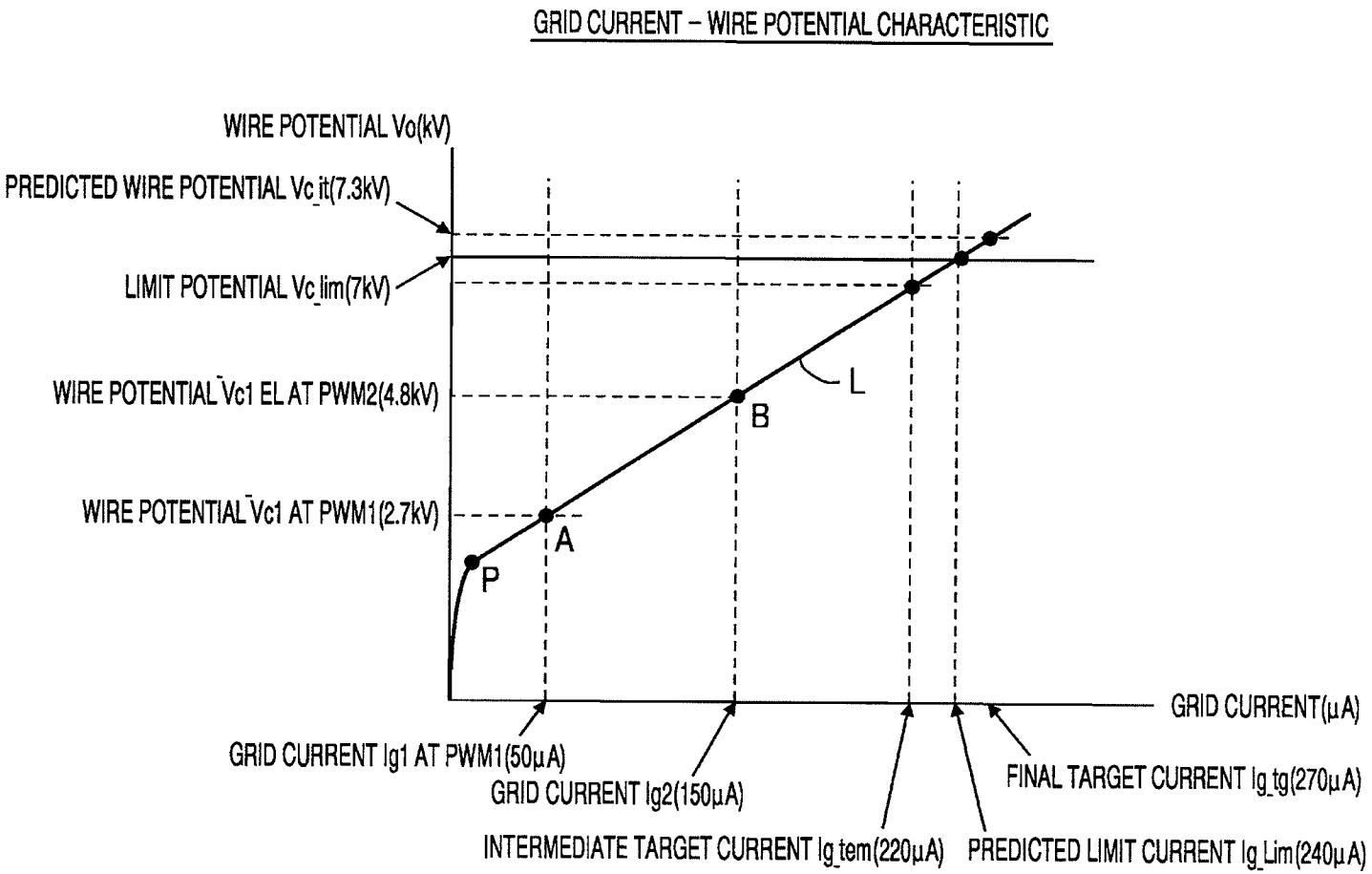
FIG. 12 is a chart illustrating a grid current-wire potential relationship in accordance with the third embodiment.

As indicated in FIG. 12, at an initial period when the wire potential Vc is output, the corona discharge will hardly be generated and thus the grid current Ig will hardly flow. Therefore, in contrast with the increased amount of the wire potential Vc, the increased amount of the grid current Ig is very small. However, when the wire potential Vc reaches a predetermined level (i.e., point P in FIG. 12), the corona discharge is stabilized, and the grid current Ig and the wire potential Vc have a proportional relationship.

Therefore, the pulse width modification signals PWM1 and PWM2 are set (in S1 and S7) so that the grid current Ig and the wire potential Vc have a proportional relationship and that the final target current Ig_tg is smaller than the final target pulse width modification signal PWM_tg (see FIG. 13), by measuring the grid current Ig and the wire potential Vc for each of the pulse width modification signals PWM1 and PWM2 (in S5 and S11), two points A and B on a line L can be calculated. That is, a linear formula regarding the line L can be obtained. Thus, the control unit 310 can calculate the predictable wire current Vc_it in S13.

In S15, the control unit 31 judges whether the thus calculated predictable wire potential Vc_it is equal to or less than a limit potential Vc_lim, which is a maximum current that does not cause the spark discharging.

If the predictable wire potential Vc_it is equal to or less than the limit potential Vc_lim (S15: YES), the contamination of the charging wire 122K2 has not progressed so much. Thus, it can be regarded that the wire potential Vc does not exceed the limit potential Vc_lim until the grid current Ig reaches the final target current Ig_tg, the normal high-voltage PWM control is executed until the grid current Ig reaches the final target current Ig_tg, the control proceeds to S17.

In S17, in order to make the grid current Ig close to the final target current Ig_tg, the control unit 310 sets the target value of the grid current Ig to the final target current Ig_tg and sets the gain of the pulse width modification signal PWM to one (1). That is, in a normal state where the charging wire 122Kw is not so contaminated, the control unit 310 executes the setting operation in S17.

In S19, the control unit 310 controls the grid current Ig to become close to the final target current Ig_tg as described with reference to the first embodiment, and continues this control (S21: NO) until application of the wire potential Vc to the charging wire 122Kw is finished in S21. When application of the wire potential Vc to the charging wire 122Kw is finished (S21: YES), the charging control process is finished. It should be noted that the application of the wire potential Vc to the charging wire 122Kw is finished when a predetermined period has elapsed since the image formation operation was finished, or when no process has been executed in the printer 1 for a predetermined period after the printer 1 was powered on or after the operation mode of the printer 1 was changed from the power save mode to the normal mode (including a case where the image formation was executed).

If the predicted wire potential Vc_it is equal to or greater than the limit potential Vc_im (S15: NO), it is regarded that the charging wire 122Kw is contaminated. In such a case, if the high-voltage PWM control is executed with the setting made in S17, there is a possibility that the overshoot of the grid current Ig occurs and the wire potential Vc exceeds the limit potential Vc_lim, which may causes the spark discharge. Therefore, in such a case, the control proceeds to S23.

In S23, the control unit 310 calculates the intermediate target current Ig_tem (see FIG. 12). According to the third embodiment, the control unit 310 uses the linear formula L1 representing the proportional relationship between the grid current Ig and the wire potential Vc, which is obtained in S13, and the limit potential Vc_lim, the predicted limit current Ig_lim corresponding to the limit potential Vc_lim. Then, by multiplying the thus calculated predicted limit current Ig_lim with a predetermined coefficient (e.g., 0.9), the control unit 310 calculates the intermediate target current Ig_tem.

Then, in order to make the grid current Ig become close to the intermediate target current Ig_tem, the control unit 310 sets the target value of the grid current Ig to the intermediate target current Ig_tem and sets the gain of the pulse width modification signal PWM to one. Then, in S27, the control unit 310 executes the high-voltage PWM control.

As described above, the intermediate target current Ig_tem is set to a value with which the charging voltage control unit 324 does not respond, or even responds due to a setting error or the like, the wire potential Vc does not exceed the limit potential Vc_lim even if the overshoot of the grid current Ig occurs due to delay of the responding speed. Further, the high-voltage PWM control is executed with the gain of 1, which is the gain of the normal operation, until the gird current Ig reaches the intermediate target current Ig_tem. With such a control, it is possible to suppress delay of the period within which the grid current Ig reaches the intermediate target current Ig_tem, and suppress generation of the spark discharging.

The control unit 310 executes the high-voltage PWM control for making the grid current Ig become close to the intermediate target current Ig_tem in S27. Then, in S29, the control unit 310 judges whether the grid current Ig reaches the intermediate target current Ig_tem. Until the grid current Ig reaches the intermediate target current Ig_tem, the control unit 310 repeatedly executes the high-voltage PWM control (S29: NO, S27). When the grid current Ig reaches the intermediate target current Ig_tem (S29: YES), the control unit 310 proceeds to S31. In S31, in order to make the grid current Ig become close to the predicted limit current Ig_lim, the control unit sets the target value of the grid current Ig to the predicted limit current Ig_lim, sets the gain of the pulse width moducation signal PWM to 0.2. Then, in S33, the control unit 310 executes the high-voltage PWM control with the settings made in S31.

After the grid current has reached the intermediate target current Ig_tem and before reaches the predicted limit current Ig_lim, if the high-voltage PWM control is executed with the gain of the pulse width modulation signal PWM being kept to be 1, the wire potential Vc largely overshoot the limit potential Vc_lim and it becomes very likely that the spark discharging occurs. However, as above, by setting the gain of the pulse width modulation signal PWM to a relatively small value, it becomes possible to make the grid current Ig to approach the predicted limit current Ig_lim gently, and suppress the occurrence of the spark discharging.

It should be noted that, if the grid current Ig is control to reach the final target current Ig_tg, due to the considerable contamination of the charging wire 122Kw, the wire potential Vc likely exceeds the limit potential Vc_lim as the wire potential Vc is raised so that the grid current Ig reaches the final target current Ig_tg, the wire potential Vc may exceed the limit potential Vc_lim and the spark discharging may occur easily. To avoid such a problem, according to the third embodiment, the grid current Ig is controlled to approach the predicted limit current but not to the final target current Ig_tg.

In S35, the control unit 310 judges whether the application of the wire potential Vc to the charging wire 122Kw is completed. If completed (S35: YES), the discharge voltage control process is finished. If not (S35: NO), the control unit 310 judges whether the changed amount ΔPWM of the pulse width modulation signal in the high-voltage PWM control with the gain of the pulse width modification signal PWM being set to 0.2 is less than a predetermined value (e.g., the duty ratio of 0.5%). Since the control unit 310 calculates the changed amount ΔPWM based on the deviation δ between the grid current Ig and the predicted limit current Ig_lim, if deviation δ is to small, the changed amount ΔPWM is 0 due to a truncation error. In such a case, it becomes difficult to make the grid current Ig reach the predicted limit current Ig_lim.

To deal with the above problem, if the changed amount ΔPWM is less than the predetermined amount (S37: YES), the control unit 310 updates the changed amount ΔPWM by adding a predetermined changed amount (e.g., the duty ratio of 1%) in S39 before returning to S33. With this control, it is ensured that the grid current Ig reaches the predicted limit current Ig_lim. If the changed amount ΔPWM is equal to or greater than the predetermined amount (S37: NO), it is regarded that problems due to the truncation errors will not occur and the control unit 310 continues executing the high-voltage PWM control in S33. Incidentally, it is noted that the predetermined changed amount added to the changed amount ΔPWM is set to a value (e.g., the duty ratio of 2%) with which the spark discharging would not occur.

In the above description, the control according to the third embodiment is applied to the configuration of the first embodiment. It is possible to apply the above configuration to the second embodiment. In such a case, since the high-voltage PWM control is executed for making the wire current Ic approach the target value, "grid current Ig" is replaced with the "wire current Ic" and control similar to one described above is executed.

Figure 11:
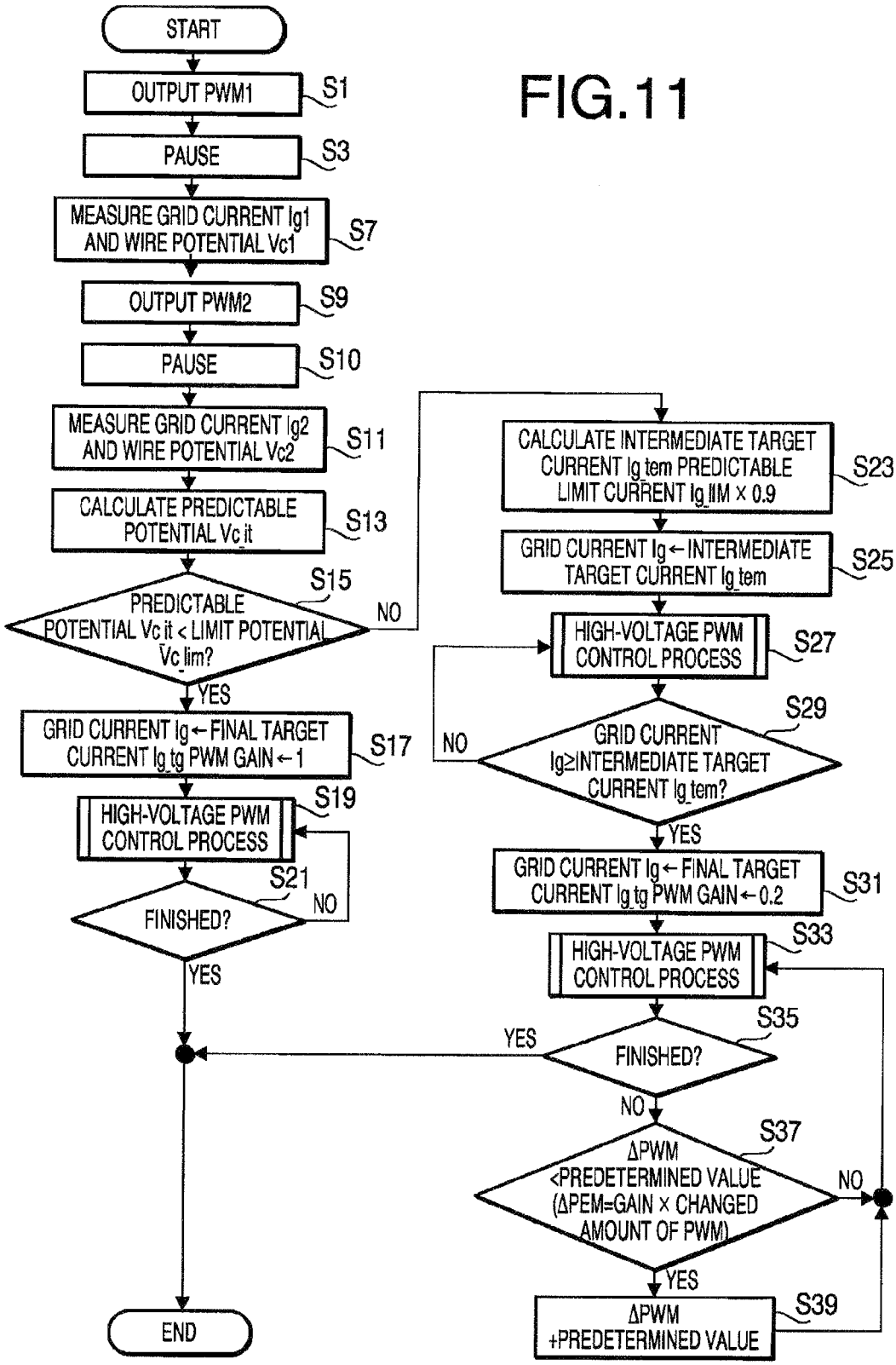
FIG. 11 is a flowchart illustrating a charging voltage control process when the high-voltage power supply is activated in accordance with a third embodiment.

Incidentally, in S31 of FIG. 11, the gain of the pulse width modification signal PWM is a fixed value (i.e., 0.2). This configuration may be modified such that the gain for the pulse width modulation signal PWM is varied in accordance with a difference between the present value of the grid current Ig and the predicted limit current Ig_lim. For example, the gain may be set to a value which is the difference, between the present value of the grid current Ig and the predicted limit current Ig_lim, divided by the predicted limit current Ig_lim.

In the first embodiment, when the grid potential is lowered, the controllable range of the wire potential is restricted so that the difference between the wire potential and the grid potential remains not more than a predetermined value. In addition to this control, the controllable range of the wire potential may also be restricted when the wire potential exceeds a predetermined threshold value.

Figure 14:
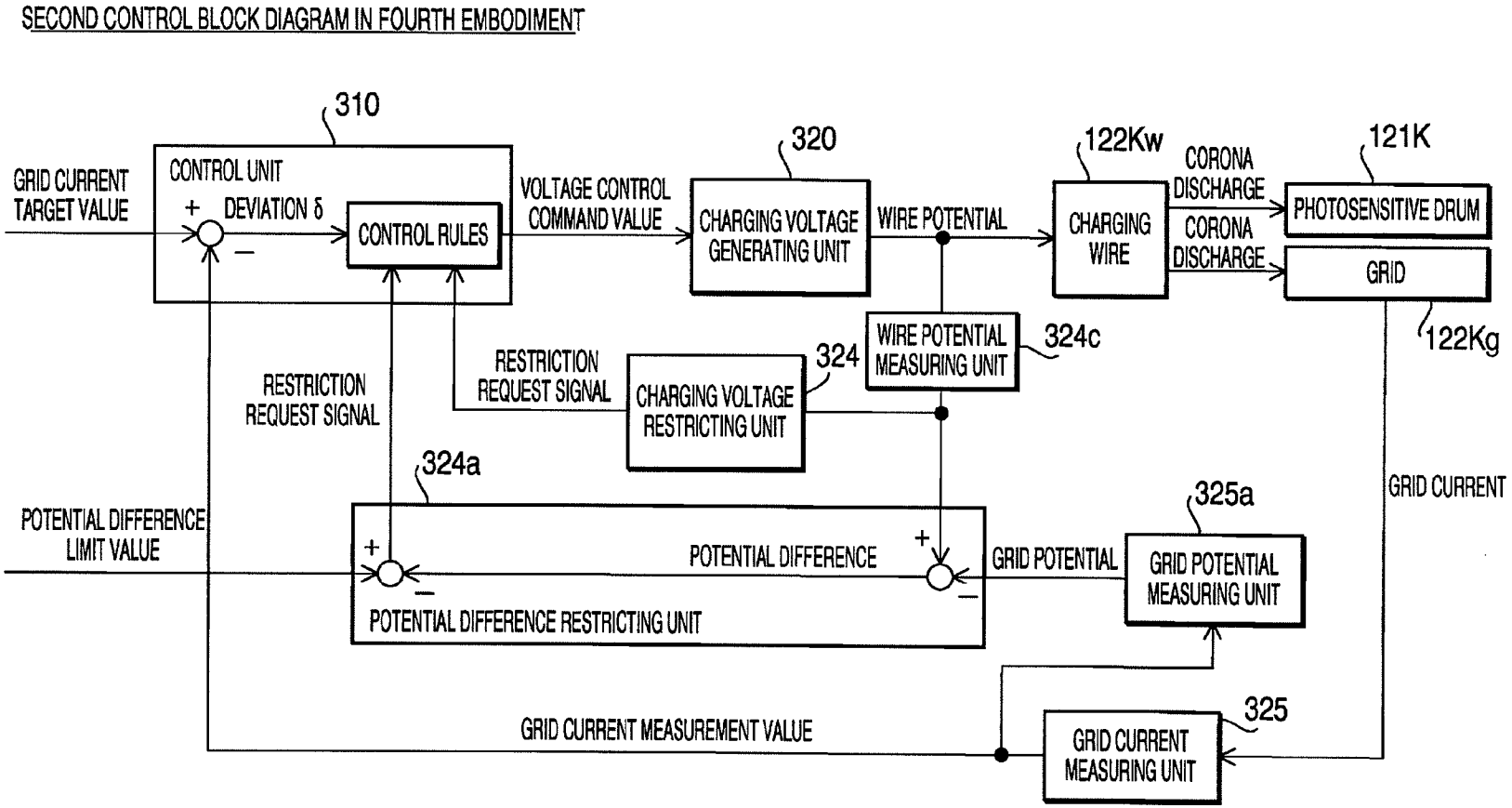
FIG. 14 is a control block diagram in accordance with a fourth embodiment.

FIG. 14 shows a block diagram of such a modification (a fourth embodiment). Specifically, the configuration of the fourth embodiment is similar to that show in FIG. 6 except that the wire potential measuring unit 324*c*, which is employed in the second embodiment described above, is employed.

Figure 15:
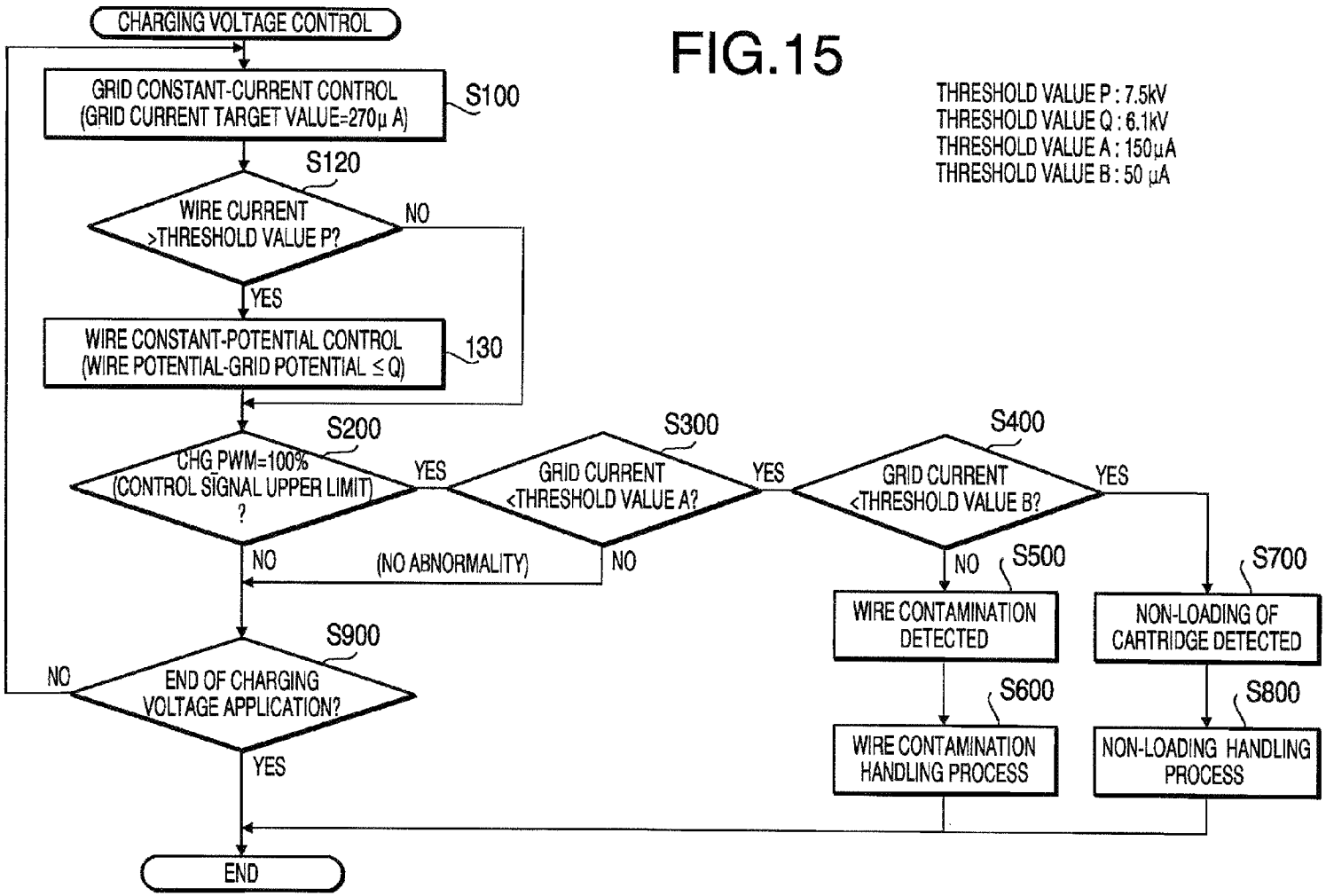
FIG. 15 is a flowchart showing a routine which implements a wire abnormality detecting method in accordance with the fourth embodiment.

FIG. 15 illustrates a routine implementing a wire abnormality detecting method according to the fourth embodiment. Since FIG. 15 is similar to FIG. 7 except that steps S120 and S130 are inserted between S100 and S200, only steps S120 and S130 will be described. In S120, the control circuit board 210 judges whether the wire potential, which is measured with the wire potential measuring unit 324*c*, exceeds a prescribed threshold value P (e.g., 7.5 kV). If the measured wire potential is greater than the prescribed threshold value (S120: YES), the control unit 310 controls the wire potential such that a result of subtraction of the grid potential from the wire potential is equal to or greater than a threshold value Q (e.g., 6.1 kV). If the measured wire potential is equal to or less than the threshold value P (S120: NO), the control circuit board 210 skips S130 and proceeds to S200.

In addition to the control according to the second embodiment, the grid potential may be controlled such that the difference between the wire potential and the grid potential is maintained to be a value which is less than a predetermined threshold value.

Figure 16:
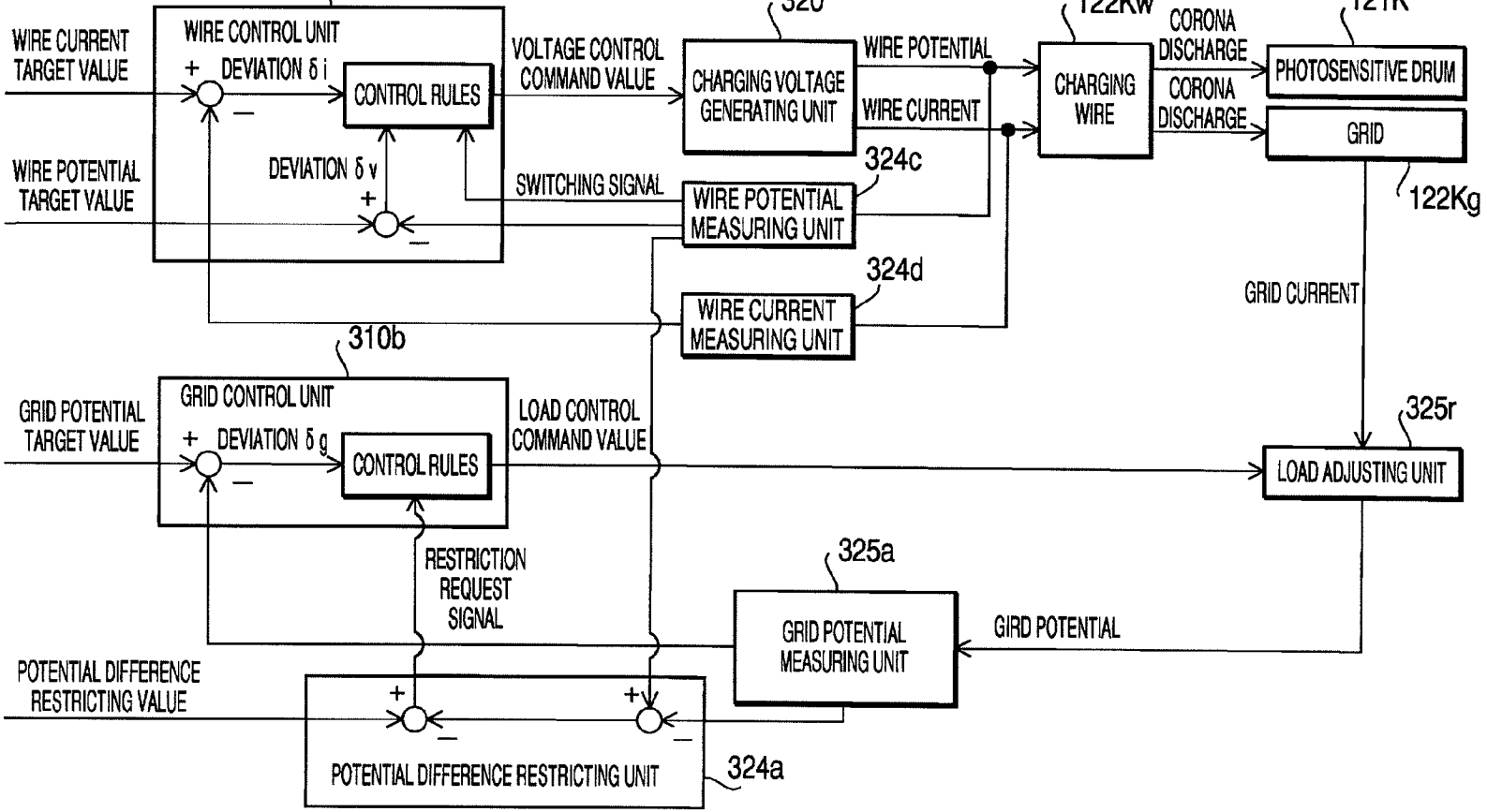
FIG. 16 is a control block diagram in accordance with fifth embodiment.

FIG. 16 illustrates a configuration of such a modification (i.e., a fifth embodiment) which is a modification of the second embodiment or a combination of first and second embodiments. In other words, as shown in FIG. 16, the configuration includes a potential difference restricting unit 324*a* in addition to the configuration similar to that of second modification.

Figure 17:
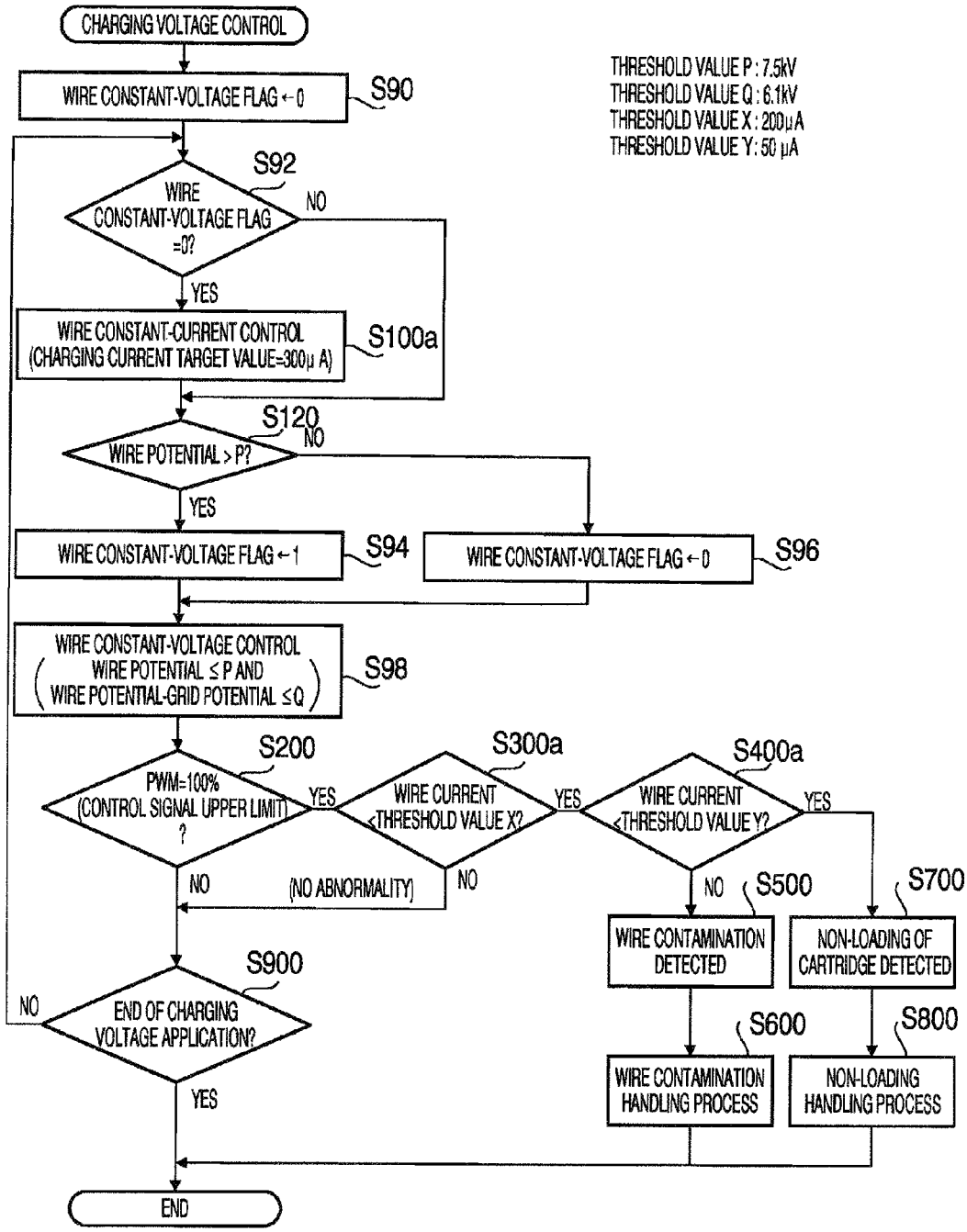
FIG. 17 is a flowchart showing a routine which implements a wire abnormality detecting method in accordance with the fifth embodiment.

FIG. 17 shows a routine implementing a wire abnormality detecting method according to the fifth embodiment. The routine shown in FIG. 17 is similar to that shown in FIG. 10 except that steps S90, S92, S94 and S96 are additionally included. Therefore, only portions different from FIG. 10 will be described.

In S90, the control circuit board sets a constant-voltage flag representing whether the wire voltage is controlled to be constant or not to zero. As will be described, the constant-voltage flag is set to one or zero in S94 or S96. If the constant-voltage flag is set to zero (S92: YES), S100*a* is executed as in FIG. 10. If the constant-voltage flag is not zero (S92: NO), S100*a* is skipped and the control circuit board 210 judges whether the measured wire potential is greater than a prescribed value (S120).

If the wire potential is greater than the prescribed value (S120: YES), the constant-voltage flag is set to one, the constant-voltage flag is set to one (S94). Then, a constant-voltage control is executed in S98. Specifically, the wire potential is controlled such that the wire potential is kept to be equal to or less than the threshold value P (e.g., 7.5 kV) and a result of subtraction of grid voltage from the wire voltage is kept to be equal to or less than the threshold value Q (e.g., 6.1 kV). Thereafter, the control circuit board 210 proceeds to S200.

If the wire potential is equal to or less than the prescribed value (S120: NO), the constant-voltage flag is set to zero (S96). Then, the control circuit board 210 proceeds to S200 without executing S98.

Figure 18:
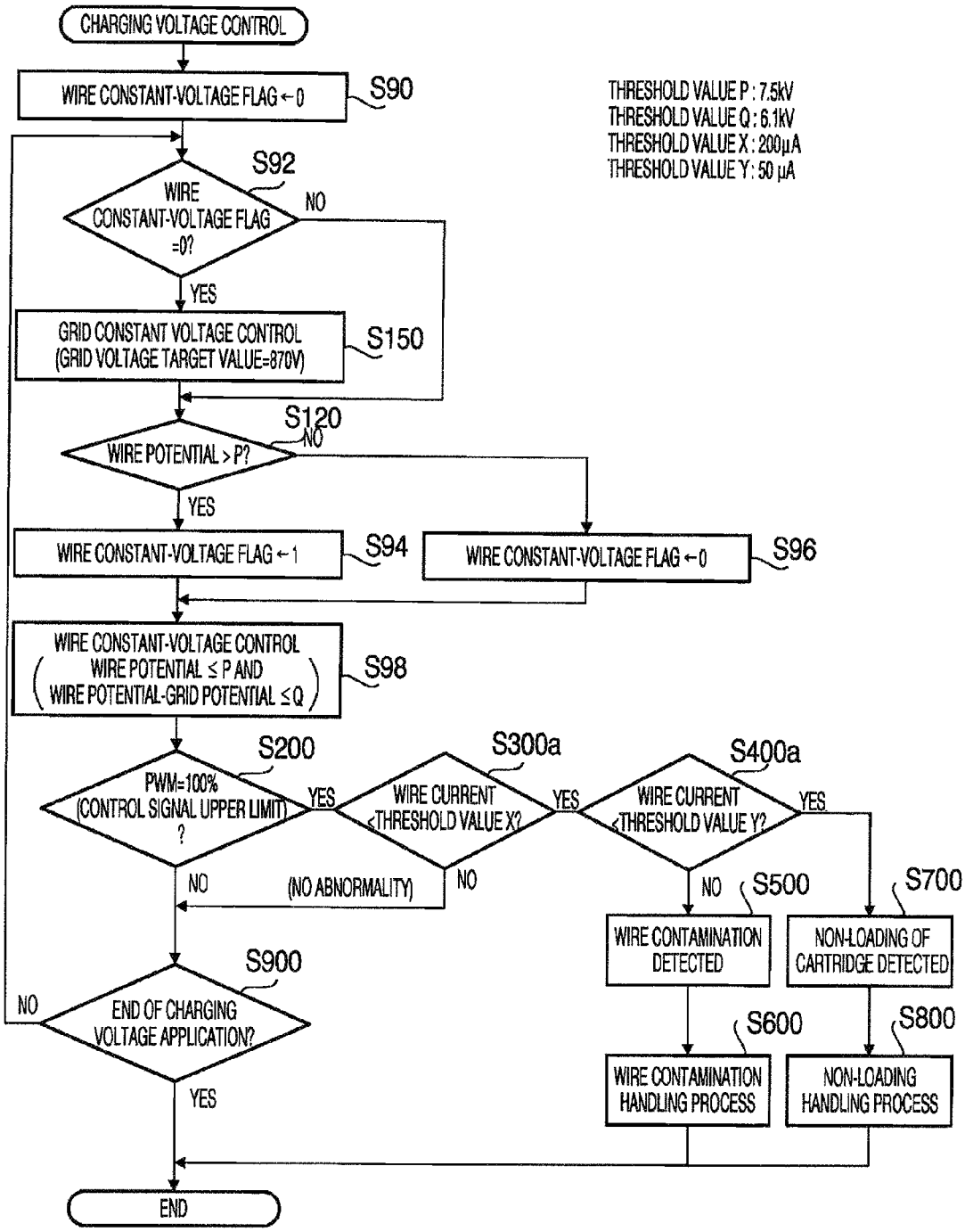
FIG. 18 is a flowchart showing a routine which implements a wire abnormality detecting method in accordance with a sixth embodiment.

FIG. 18 shows a routine implementing a wire abnormality detecting method according to a sixth embodiment which is a modification of the fifth embodiment. FIG. 18 is different from FIG. 17 in that step S100*a* is replaced with step S150 which is similar to S150 of FIG. 10.

Incidentally, the above-described configurations of the embodiments/modifications can be implemented in various forms, such as an image formation device, an image formation method, a power supply control device, a power supply control method, a power supply equipped with the power supply control device, an image formation device equipped with the power supply, a program or program product implementing the power supply control, etc.

What is claimed is:

1. An image formation device for forming an image on a print medium by an electrophotographic process, comprising:

a photosensitive body on which a developer image to be transferred to the print medium is formed by the electrophotographic process including charging of the photosensitive body;

a charging unit which includes a charging wire and a grid and thereby electrically charges the photosensitive body;

a charging power unit which applies a wire potential to the charging wire;

a wire potential measuring unit which measures the wire potential;

a charging control unit which controls the amount of electric charge supplied from the charging unit to the photosensitive body by controlling the wire potential based on the wire potential measured by the wire potential measurement unit, wherein the charging control unit includes a control range restricting unit which restricts a control range of the wire potential within a prescribed electric potential; and a grid output measuring unit which measures at least one selected from a grid potential as electric potential of the grid and a grid current as electric current passing through the grid, wherein:

the charging control unit executes the control in a grid output control mode in which at least one selected from the grid potential and the grid current is controlled to be at a constant level by controlling the wire potential in order to control the amount of the electric charge supplied from the charging unit to the photosensitive body, and the grid output control mode is a control mode in which the control range of the wire potential is restricted further so that potential difference between the wire potential and the grid potential is kept less than or equal to a preset second threshold value when the wire potential has exceeded a preset first threshold value.

2. The image formation device according to claim 1, wherein the charging control unit judges that the charging wire has been contaminated when the potential difference between the wire potential and the grid potential has exceeded the second threshold value.

3. The image formation device according to claim 1, wherein the control range restricting unit includes a Zener diode which detects whether the wire potential has exceeded the first threshold value.

4. The image formation device according to claim 1, wherein the charging control unit judges that the charging wire has been contaminated when the grid current is less than a preset third threshold value.

5. The image formation device according to claim 4, wherein the charging control unit judges that a cartridge storing developer has not been loaded in the image formation device when the grid current is less than a fifth threshold value which is less than the third threshold value or a wire current as electric current passing through the charging wire is less than a sixth threshold value.

6. An image formation device for forming an image on a print medium by an electrophotographic process, comprising:

a photosensitive body on which a developer image to be transferred to the print medium is formed by the electrophotographic process including charging of the photosensitive body;

a charging unit which includes a charging wire and a grid and thereby electrically charges the photosensitive body;

a charging power unit which applies a wire potential to the charging wire;

a wire potential measuring unit which measures the wire potential;

a charging control unit which controls the amount of electric charge supplied from the charging unit to the photosensitive body by controlling the wire potential based on the wire potential measured by the wire potential measurement unit, wherein the charging control unit includes a control range restricting unit which restricts a control range of the wire potential within a prescribed electric potential; and a wire current measuring unit which measures a wire current as electric current passing through the charging wire, wherein:

the charging control unit is capable of executing the control in a wire constant-current control mode and in a wire constant-potential control mode and switches its control mode from the wire constant-current control mode to the wire constant-potential control mode when the wire potential has exceeded a preset first threshold value, and the wire constant-current control mode is a control mode in which the wire current is controlled to be at a constant level by controlling the wire potential in order to control the amount of the electric charge supplied from the charging unit to the photosensitive body, and the wire constant-potential control mode is a control mode in which the wire potential is controlled to be at a constant level less than or equal to the first threshold value while controlling a grid potential as electric potential of the grid so that potential difference between the wire potential and the grid potential is kept less than or equal to a preset second threshold value.

7. The image formation device according to claim 6, further comprising:

a load adjusting unit which adjusts a grid load as a load against a grid current passing through the grid; and a grid potential control unit which controls the grid potential by controlling the adjustment of the grid load performed by the load adjusting unit.

8. The image formation device according to claim 6, further comprising:

a grid power supply unit which supplies electric power to the grid; and a grid power supply control unit which controls the grid potential to be at a constant level by controlling the grid power supply unit.

9. The image formation device according to claim 6, wherein the charging control unit judges that the charging wire has been contaminated when the potential difference between the wire potential and the grid potential has exceeded the second threshold value.

10. The image formation device according to claim 6, wherein the charging control unit judges that the charging wire has been contaminated when the wire current is less than a preset fourth threshold value.

11. The image formation device according to claim 10, wherein the charging control unit judges that a cartridge storing developer has not been loaded in the image formation device when a grid current as electric current passing through the grid is less than a fifth threshold value or the wire current is less than a sixth threshold value which is less than the fourth threshold value.

12. An image formation device for forming an image on a print medium by an electrophotographic process, comprising:

a photosensitive body on which a developer image to be transferred to the print medium is formed by the electrophotographic process including charging of the photosensitive body;

a charging unit which includes a charging wire and a grid and thereby electrically charges the photosensitive body;

a charging power unit which applies a wire potential to the charging wire;

a wire potential measuring unit which measures the wire potential;

a charging control unit which controls the amount of electric charge supplied from the charging unit to the photosensitive body by controlling the wire potential based on the wire potential measured by the wire potential measurement unit, wherein the charging control unit includes a control range restricting unit which restricts a control range of the wire potential within a prescribed electric potential; and a grid output measuring unit which measures at least one selected from a grid potential as electric potential of the grid and a grid current as electric current passing through the grid, wherein:

the charging control unit is capable of executing the control in a grid output control mode and in a wire constant-potential control mode and switches its control mode from the grid output control mode to the wire constant-potential control mode when the wire potential has exceeded a preset first threshold value, and the grid output control mode is a control mode in which at least one selected from the grid potential and the grid current is controlled to be at a constant level by controlling the wire potential in order to control the amount of the electric charge supplied from the charging unit to the photosensitive body, and the wire constant-potential control mode is a control mode in which the wire potential is controlled to be at a constant level less than or equal to the first threshold value while controlling the grid potential so that potential difference between the wire potential and the grid potential is kept less than or equal to a preset second threshold value.

13. The image formation device according to claim 12, further comprising:

a load adjusting unit which adjusts a grid load as a load against the grid current passing through the grid; and a grid potential control unit which controls the grid potential by controlling the adjustment of the grid load performed by the load adjusting unit.

14. The image formation device according to claim 12, further comprising:

a grid power supply unit which supplies electric power to the grid; and a grid power supply control unit which controls the grid potential to be at a constant level by controlling the grid power supply unit.

15. The image formation device according to claim 12, wherein the charging control unit judges that the charging wire has been contaminated when the potential difference between the wire potential and the grid potential has exceeded the second threshold value.

16. An image formation device for forming an image on a print medium by an electrophotographic process, comprising:

a photosensitive body on which a developer image to be transferred to the print medium is formed by the electrophotographic process including charging of the photosensitive body;

a charging unit which includes a charging wire and a grid and thereby electrically charges the photosensitive body;

a charging power unit which applies a wire potential to the charging wire;

a wire potential measuring unit which measures the wire potential; and a charging control unit which controls the amount of electric charge supplied from the charging unit to the photosensitive body by controlling the wire potential based on the wire potential measured by the wire potential measurement unit, the charging control unit including a control range restricting unit which restricts a control range of the wire potential within a prescribed electric potential;

a grid output measuring unit which measures at least one selected from a grid potential as electric potential of the grid and a grid current as electric current passing through the grid, wherein:

the charging control unit executes the control in a grid output control mode in which at least one of the grid potential and the grid current is controlled to be at a constant level by controlling the wire potential in order to control the amount of the electric charge supplied from the charging unit to the photosensitive body, and the grid output control mode is a control mode in which a duty ratio of a pulse width modulation signal controlling the wire potential reaches 100% at an upper limit of the prescribed control range of the wire potential.

* * * * *